US009417034B1

(12) United States Patent
Swan

(10) Patent No.: US 9,417,034 B1
(45) Date of Patent: Aug. 16, 2016

(54) BALLISTIC ALIGNMENT DUAL AUTOMATIC SIGHT SWITCH OPTIC MOUNT

(71) Applicant: Richard E. Swan, E. Bridgewater, MA (US)

(72) Inventor: Richard E. Swan, E. Bridgewater, MA (US)

( * ) Notice: Subject to any disclaimer, the term of this patent is extended or adjusted under 35 U.S.C. 154(b) by 500 days.

(21) Appl. No.: 14/099,241

(22) Filed: Dec. 6, 2013

(51) Int. Cl.
*F41G 1/00* (2006.01)
*F41G 1/17* (2006.01)

(52) U.S. Cl.
CPC ..... *F41G 1/17* (2013.01)

(58) Field of Classification Search
CPC ..... F41G 1/17; F41G 1/38; F41G 1/387; F41G 11/00; F41G 11/001; F41G 11/004; F41G 11/005; F41G 11/008
See application file for complete search history.

(56) References Cited

U.S. PATENT DOCUMENTS

| | | | | |
|---|---|---|---|---|
| 944,916 | A | 12/1909 | Shepard | |
| 1,083,288 | A | 1/1914 | Lowe | |
| 2,115,618 | A | 4/1938 | Carl | |
| 2,367,762 | A | 1/1945 | Eiane | |
| 2,425,130 | A | 8/1947 | Shelley | |
| 2,445,087 | A | 7/1948 | Rogers | |
| 2,527,289 | A | 10/1950 | Allen | |
| 2,529,801 | A | 11/1950 | Fisk | |
| 2,571,935 | A | 10/1951 | Pachmayr et al. | |
| 2,629,175 | A | 2/1953 | Merritt | |
| 2,639,507 | A | 5/1953 | Pachmayr | |
| 2,644,237 | A | 7/1953 | Pachmayr | |
| 2,710,453 | A | 6/1955 | Beverly | |
| 2,773,310 | A * | 12/1956 | Bircher | F41G 11/008 42/136 |
| 2,803,880 | A | 8/1957 | Weaver | |
| 3,178,823 | A | 4/1965 | Lipski | |
| 4,092,793 | A | 6/1978 | Ricks | |
| 4,092,899 | A | 6/1978 | Lienau | |
| 4,461,087 | A | 7/1984 | Norman | |
| 6,026,580 | A | 2/2000 | LaRue | |
| 6,705,037 | B2 | 3/2004 | Van Kirk | |
| 7,272,904 | B2 | 9/2007 | Larue | |
| 7,367,152 | B2 | 5/2008 | Samson | |
| 7,369,302 | B2 * | 5/2008 | Gaber | F41G 1/32 250/214 VT |
| 7,730,655 | B2 | 6/2010 | Spuhr | |
| 7,908,782 | B1 | 3/2011 | LaRue | |
| 8,499,485 | B2 * | 8/2013 | Deros | F41G 11/003 42/124 |
| 8,935,875 | B2 * | 1/2015 | Collin | F41G 11/003 42/124 |
| 9,217,621 | B2 * | 12/2015 | He | F41G 1/387 |

(Continued)

FOREIGN PATENT DOCUMENTS

| | | | | |
|---|---|---|---|---|
| DE | GB 2523254 A * | 8/2015 | | F41G 1/38 |

*Primary Examiner* — Gabriel Klein
(74) *Attorney, Agent, or Firm* — Barlow, Josephs & Holmes, Ltd.

(57) ABSTRACT

An optic mount for a firearm allows a user to switch between a primary optic and a secondary optic, facilitating rapid target acquisition when a user switches between close quarter engagement and long range engagement. The base of the optic mount is securable to a firearm. A primary optic platform can be pivoted and linearly translated with respect to the base. The primary optic platform is spring biased toward the front of the base. An actuator mechanism rotates a secondary optic platform on the base from a spring-biased first orientation to a second orientation. When in the first position, the primary optic platform engages the actuator mechanism, causing the secondary optic platform to be rotated to the second orientation. When in the second position, the primary optic platform does not engage the actuator mechanism, allowing the secondary optic platform to rotate to the first orientation.

10 Claims, 26 Drawing Sheets

(56) References Cited

U.S. PATENT DOCUMENTS

| | | | | |
|---|---|---|---|---|
| 2003/0192224 | A1 | 10/2003 | Kirk | |
| 2004/0244263 | A1 | 12/2004 | Pettersson et al. | |
| 2006/0123686 | A1 | 6/2006 | Larue | |
| 2006/0162227 | A1 | 7/2006 | Samson | |
| 2011/0099881 | A1* | 5/2011 | Jung | F41G 1/38 42/113 |
| 2011/0296731 | A1* | 12/2011 | Carlson | F41G 11/003 42/90 |
| 2013/0036650 | A1* | 2/2013 | Larue | F41G 11/003 42/148 |

* cited by examiner

BALLISTIC ALIGNMENT DUAL AUTOMATIC SIGHT SWITCH OPTIC MOUNT

BACKGROUND AND SUMMARY OF THE INVENTION

The instant invention relates to universal optic mounts for firearms, and more particularly to a ballistic alignment optic mount that accommodates dual sights that can be automatically switched back and forth.

The instant invention provides a universal optic mount for supporting both a primary magnifying optic and a secondary non-magnifying optic on a firearm for use in both close quarter engagement and long range engagement.

The optic mount is provided to a user separately from the firearm. A primary optic and a secondary optic may be mounted on the optic mount by the manufacturer, or, more likely, the primary and secondary optics may be secured on the optic mount by the user. The optic mount is particularly useful for a primary optic that is a telescopic or magnifying sight, and a secondary optic that is a non-magnifying sight, such as a miniature reflex sight. The primary optic and secondary optic are useful independently of each other, and a user may easily switch back and forth between the two when acquiring a target, as described in more detail below. It should also be noted that the mounting platforms are universally suitable for use with virtually any combination of magnifying and non-magnifying optics of any manufacturer. It is also contemplated that in some embodiments (not shown) that the magnifying and non-magnifying optics could also be mounted in the reverse configuration with the non-magnifying optic in the primary position.

The base of the optic mount is releasably secured to the receiver of the firearm or a hand guard secured to the firearm. The base has a lower surface that is configured to engage a universal dovetail rail on a firearm or on a hand guard secured to the firearm. A locking assembly on the base releasably secures the base of the optic mount in place on the dovetail rail.

The primary optic is mounted on a swing arm assembly, which includes a swing arm and a locking post. The locking post can be selectively engaged to prevent undesired movement of the swing arm, as described below.

The swing arm allows the user to move the primary optic from a first position in which the primary optic is secured over the upper receiver of the firearm to a second position in which it is offset to the side. To allow this movement, the swing arm is rotatably secured to the base by a shaft that extends through the base and the swing arm. The swing arm has an upper surface configured to receive a lower housing portion of the primary optic. The user can move the swing arm linearly along the shaft with respect to the base, and can pivot the swing arm about the base.

When the primary optic is in the first position, the locking post is received in a first locking recess defined on the base. Optionally, the swing arm may be further secured by a first locking aperture on a first locking structure on the swing arm that engages a first dowel pin that extends outwardly from the base.

When the primary optic is in the second position, a second dowel pin and the locking post each prevent it from pivoting with respect to the base. A second locking aperture on a second locking structure on the swing arm engages a second dowel pin that extends outwardly from the base. Additionally, the locking post is received in a second locking recess defined on the base.

When the swing arm is in either the first or second position, it cannot be pivoted about the shaft until the user pulls the swing arm rearward, opposing a spring that causes the swing arm to be spring-biased forward. The spring extends around at least a portion of the shaft, and is received within a spring receiver on the base. The spring has a first end that engages a surface on the swing arm, and a second end that engages a spring retainer that is secured to the base.

Rearward movement of the swing arm disengages the locking post, and the optional first dowel pin when the swing arm is being moved from the first position; and rearward movement of the swing arm disengages the second locking aperture and the locking post when the swing arm is being moved from the second position.

When a user moves the primary optic between the first and second position, the secondary optic is automatically rotated between a first orientation and a second orientation. When the primary optic is in the first position, the secondary optic is in the second orientation. Alternatively, when the primary optic is in the second position, the secondary optic is in the first orientation. This automatic movement of the secondary optic is made possible by a swivel platform that is actuated by a cam mechanism.

The swivel platform is rotatably positioned over the base and secured to a swivel shaft that is rotatably secured within the base. A secondary optic is fastened to the upper surface of the swivel platform which accepts most miniature reflex sight bases. The swivel platform is rotatable from a first orientation in which the sight line of the secondary optic is substantially parallel to the barrel of the firearm to a second orientation in which the sight line of the secondary optic is substantially perpendicular to the barrel of the firearm.

The swivel platform is spring-biased to the first orientation by a torsional spring. The torsional spring has a first end secured to the swivel platform and a second end secured to the base.

This spring bias is opposed by motion of the swivel shaft, which is actuated by engagement with the swing arm assembly. The swivel shaft has a cam surface. A push rod extends within the base, and has a first end for engaging the cam surface to rotate the swivel shaft. The push rod has a second end that has a push rod face for engaging an actuator portion of the swing arm assembly. When the swing arm is in the first position, the actuator portion of the swing arm assembly engages the push rod face, thus moving the push rod against the cam surface and rotating the swivel shaft and swivel platform. When the swing arm is in the second position, the torsional spring causes the swivel platform to rotate to the first orientation.

Rotation of the swivel platform is limited by at least one stop wall formed on the base. Each stop wall engages a respective side surface of the swivel platform. This is particularly useful to limit rotation of the swivel platform with respect to the base beyond the first orientation.

The user can secure a shield to the base over the secondary optic. This shield protects the lens of the secondary optic when it is in the second orientation.

In summary, when a user desires to acquire a target by viewing the target through the primary magnifying optic, the user arranges the optic mount in a first configuration. In the first configuration, the primary optic is in the first position, with the spring biasing the spring arm forward; the actuator portion of the swing arm assembly is in engagement with the push rod face so the cam surface of the swivel shaft is rotated and the secondary optic is in the second orientation and the locking rod engages the first locking recess to prevent rotation of the primary optic about the shaft. Optionally, the first locking aperture engages the first dowel pin, to prevent rotation of the primary optic about the shaft.

Alternatively, when a user desires to acquire a target by viewing the target through the secondary optic, the user arranges the optic mount in a second configuration in which the primary magnifying optic is in the second position, with the spring biasing the swing arm forward; the second locking aperture engages the second dowel pin, to prevent rotation of the primary optic about the shaft; the locking rod engages the second locking recess to further prevent rotation of the primary optic about the shaft; and the torsional spring biases the secondary non-magnifying optic to the first orientation with its sight line parallel to the barrel of the firearm.

Accordingly, among the objects of the instant invention are: the provision of an optic mount for a firearm that allows a user to easily and rapidly switch back and forth between a primary optic and a secondary optic. Another object of the present invention is to provide an optic mount that provides a primary optic and a secondary optic that operate independently of one another.

Other objects, features and advantages of the invention shall become apparent as the description thereof proceeds when considered in connection with the accompanying illustrative drawings.

DESCRIPTION OF THE DRAWINGS

In the drawings which illustrate the best mode presently contemplated of carrying out the present invention.

DESCRIPTION OF THE PREFERRED EMBODIMENT

Figure 1:
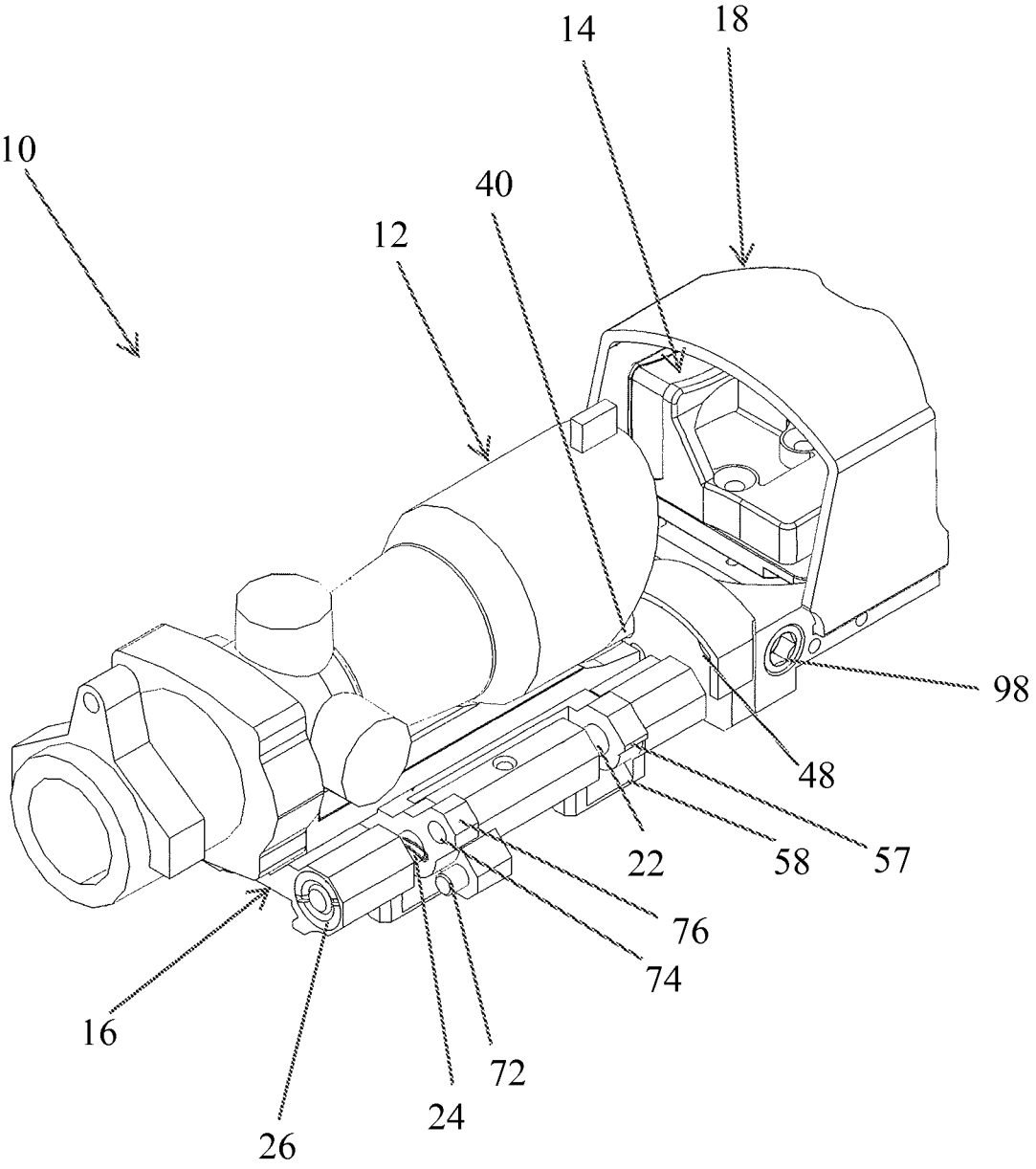
FIG. 1 is a perspective view of a first embodiment of the optic mount of the present invention in a first configuration.

Referring now to the drawings, the universal optic mount of the instant invention is illustrated and generally indicated at 10 in FIGS. 1-20. As will hereinafter be more fully described, the optic mount allows a firearm user to alternate rapidly and easily between target acquisition through a primary optic and target acquisition through a secondary optic.

The optic mount 10 of the present invention provides a universal optic mounting system that allows easy and rapid engagement and disengagement of a primary optic 12 and a secondary optic 14 mounted to a firearm (not shown). In the exemplary embodiment, the primary optic 12 is a magnifying sight, useful for long range engagement, such as fixed 4× magnifying optic. The secondary optic 14 is a non-magnifying sight (1×), such as a miniature reflex sight. The primary optic 12 and the secondary optic 14 are each capable of operating independently of the other. While the exemplary embodiment of the mount is illustrated and described in connection with these exemplary sights, it should be understood that the mount 10 is a universal mount which is configurable for use with any combination of magnifying and non-magnifying optics mounted in either the primary or secondary position on the mount.

Engagement and disengagement of the primary optic 12 causes disengagement and engagement, respectively, of a secondary optic 14, without the need to realign the primary and secondary optics when each optic is selectively engaged. This allows a user to easily transition between close quarter engagement and long range engagement or vice versa.

Figure 2:
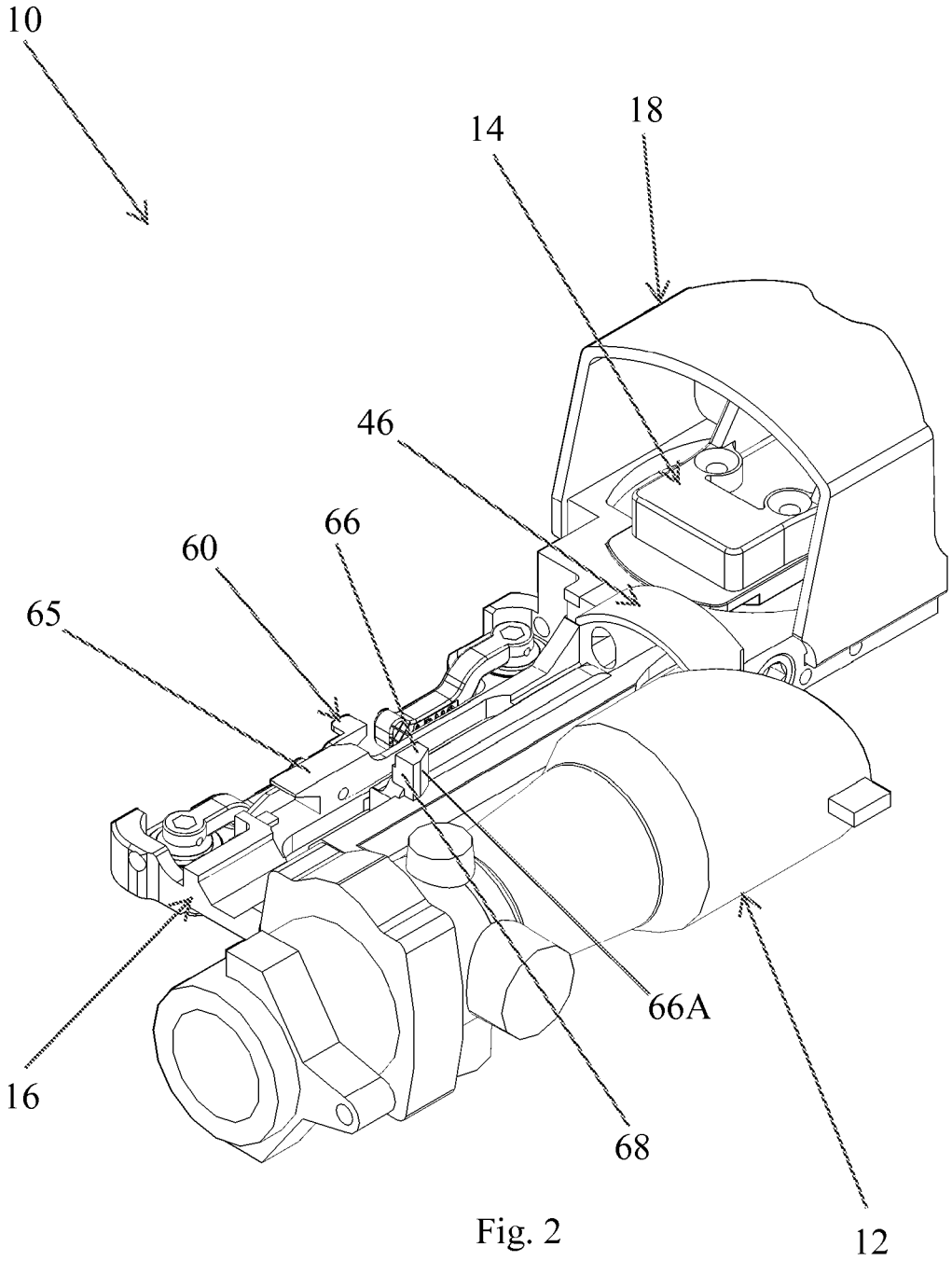
FIG. 2 is a perspective view thereof in a second configuration.

FIGS. 1 and 2 show perspective views of the optic mount 10 of the present invention in two alternate configurations. FIG. 1 shows a first configuration, in which the user can acquire a target through the primary optic 12. The primary optic 12 is secured in a first position, and the secondary optic 14 is rotated to a second orientation, so that it is substantially out of the sight line of the primary optic. FIG. 2 shows a second configuration, in which the user can acquire a target through the secondary optic 14. The secondary optic 14 is rotated to a first orientation, and the primary optic 12 is pivoted to a second position, so that it is out of the sight line of the secondary optic 14.

Figure 9:
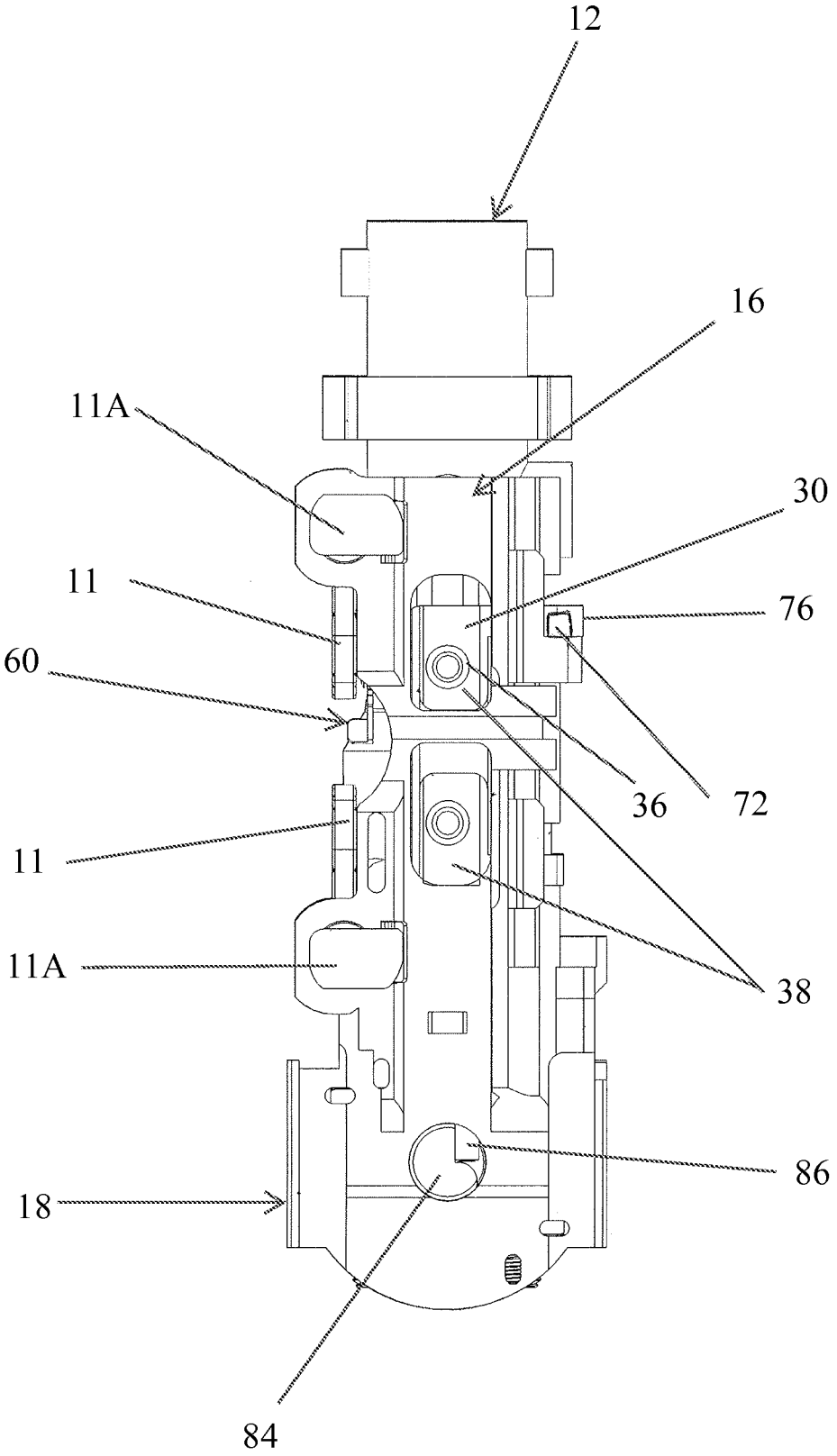
FIG. 9 is a bottom view of the optic mount in a first configuration.

A typical firearm has a universal dovetail rail for attaching accessories such as sights. The optic mount of the present invention has a base with a lower surface that is configured to engage a universal dovetail rail on the firearm or on a hand guard secured to the firearm. When the user places the optic mount on the rail, the user secures the optic mount in place by a base locking mechanism or locking assembly. A typical base locking assembly 11 is visible in the top view of FIG. 3, with the levers rotated into the locked position. Each lever rotates a plate 11A to extend below the dovetail rail. The bottom view in FIG. 9 shows the plates 11A.

Figure 3:
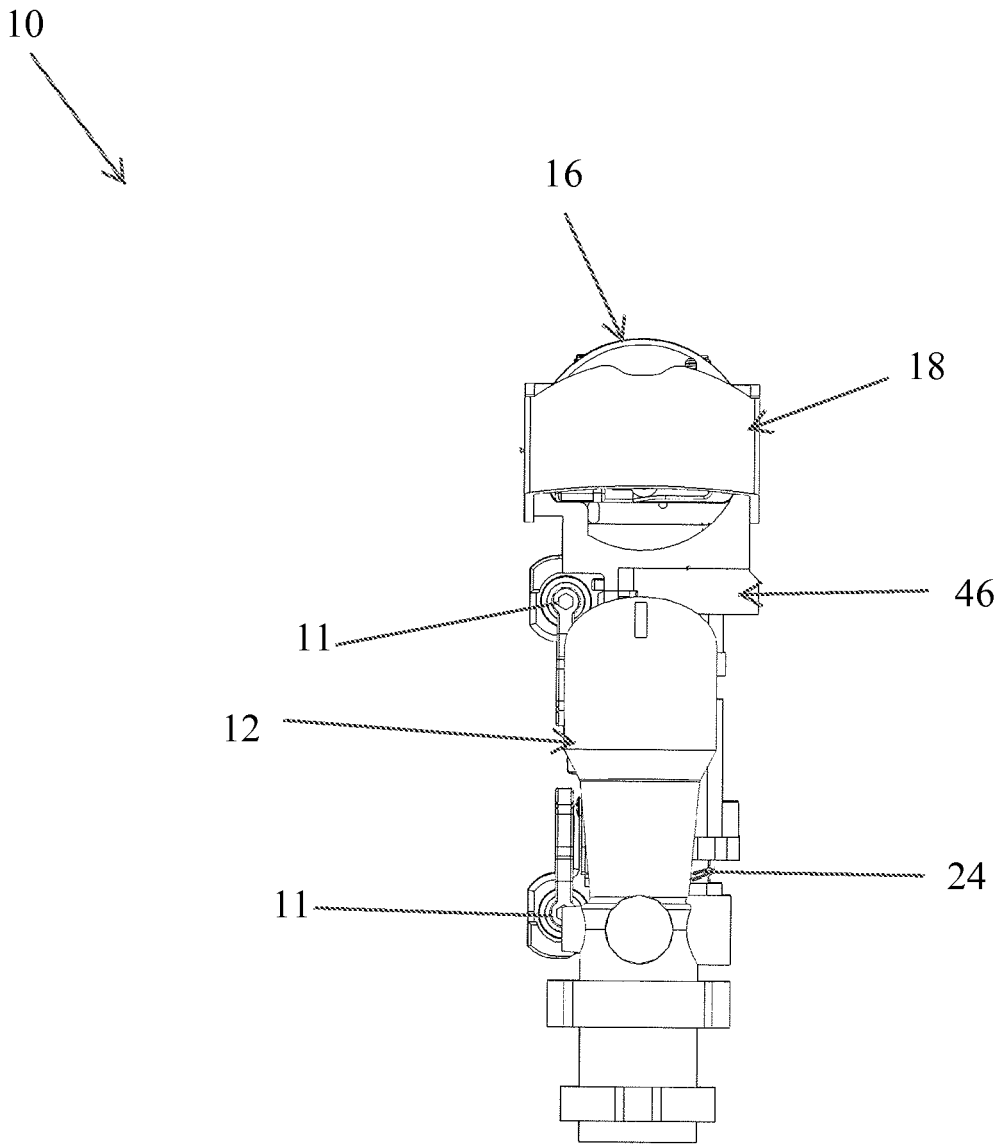
FIG. 3 is a top view of the first embodiment of the optic mount of the present invention in a first configuration.
Figure 4:
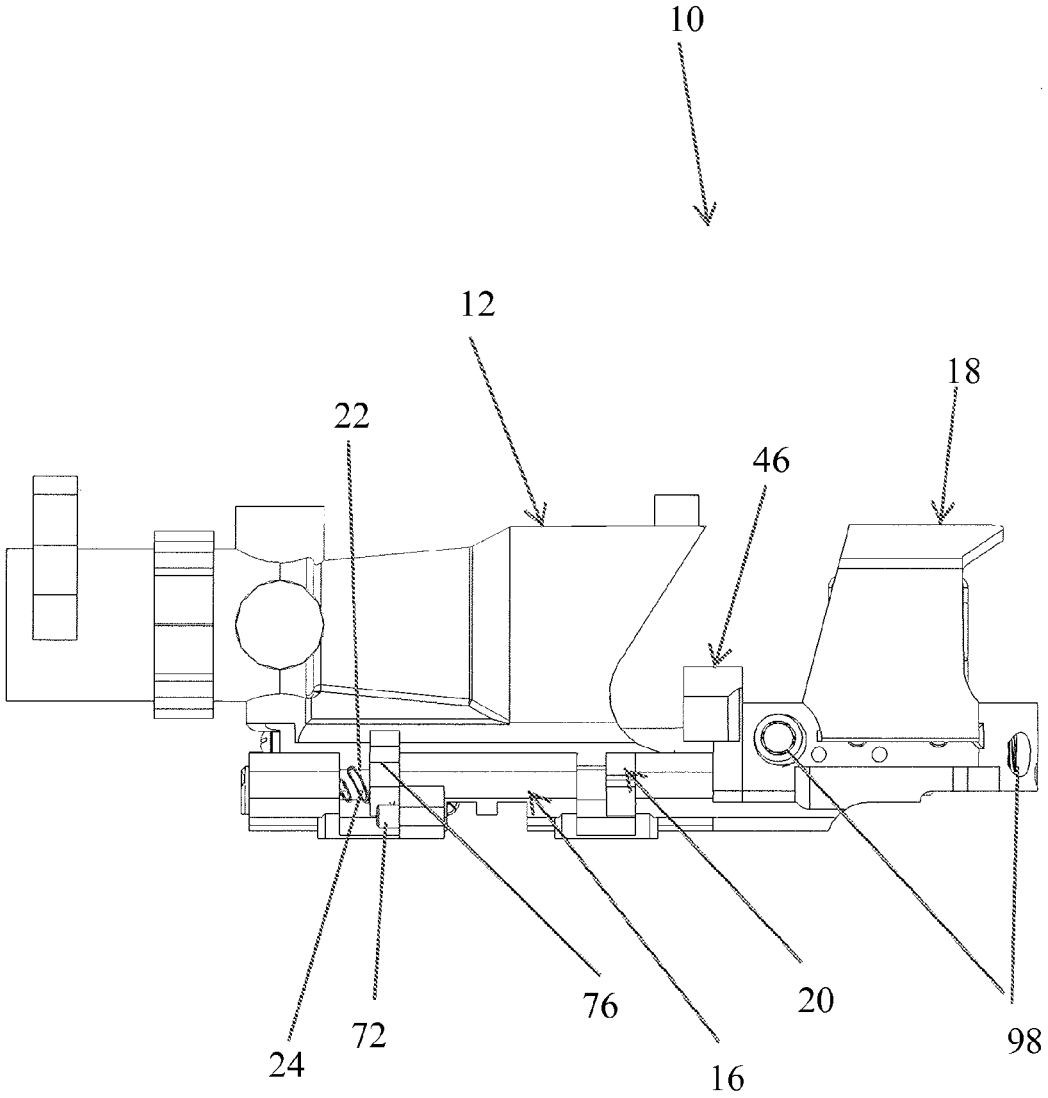
FIG. 4 is a left view thereof.

FIGS. 3 and 4 show top and left views of the optic mount 10, with the primary optic 12 in the first position over the base 16. When the base 16 of the optic mount 10 is secured to the firearm and the primary optic 12 is in the first position, the sight line of the primary optic 12 is substantially parallel with the barrel of the firearm (not shown).

Figure 5:
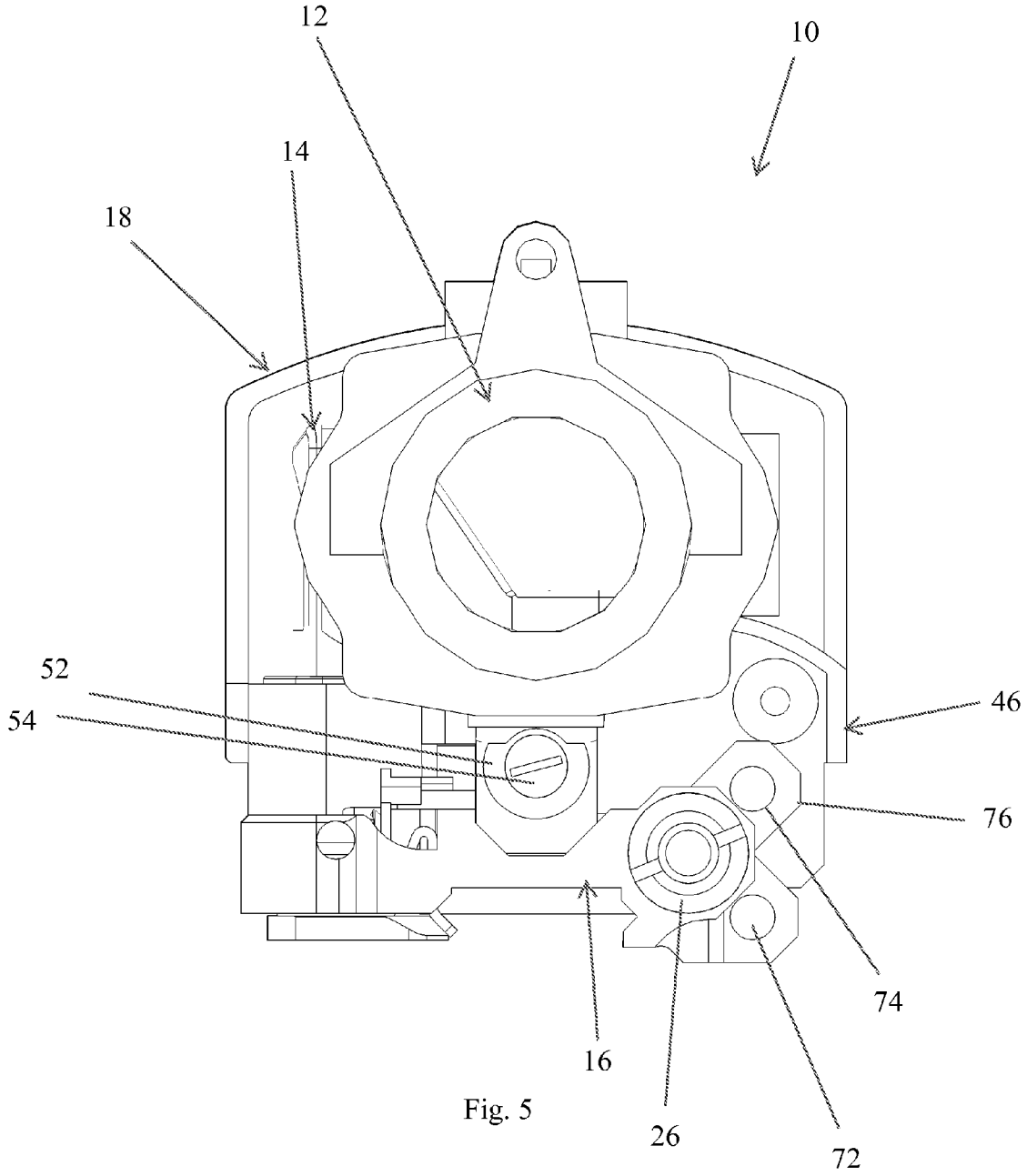
FIG. 5 is a rear view thereof.
Figure 6:
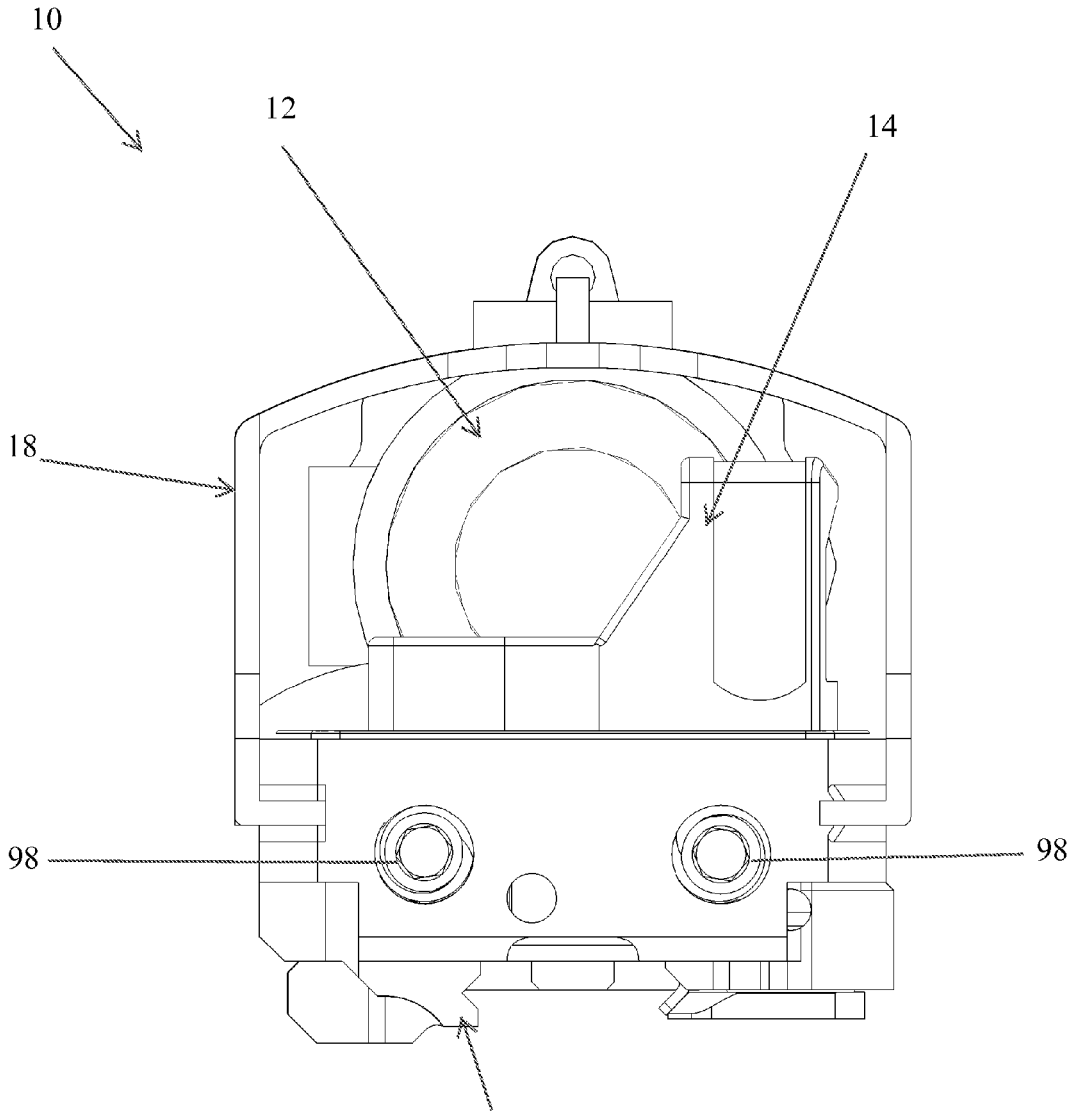
FIG. 6 is a front view thereof.

FIGS. 5 and 6 show that when the primary optic 12 is in the first position and the secondary optic 14 is in the second orientation, the secondary optic 14 does not substantially interfere with the sight line of the primary optic 12.

Figure 7A:
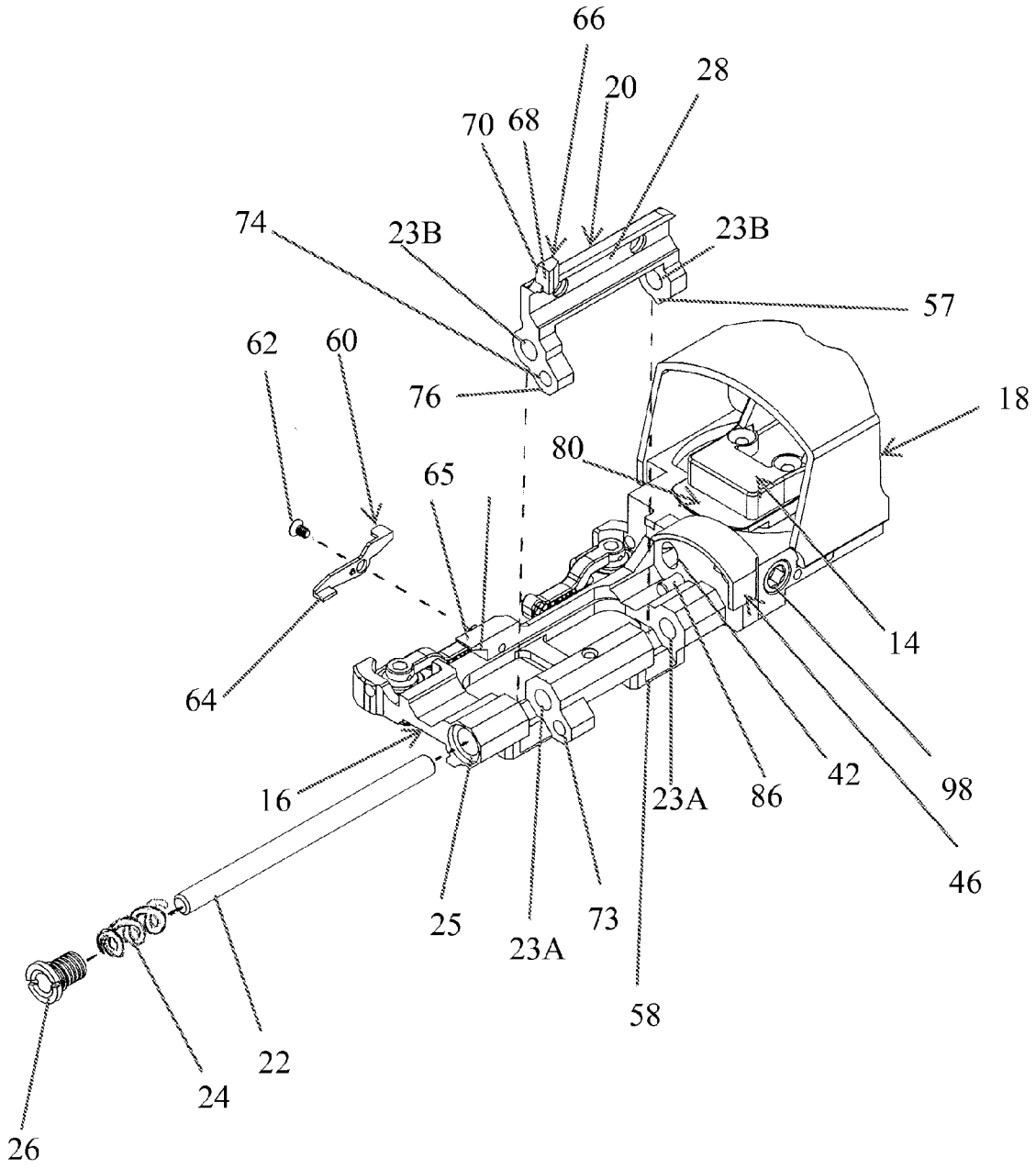
FIG. 7A is an exploded view of the swing arm assembly and the base and the locking switch.
Figure 7B:
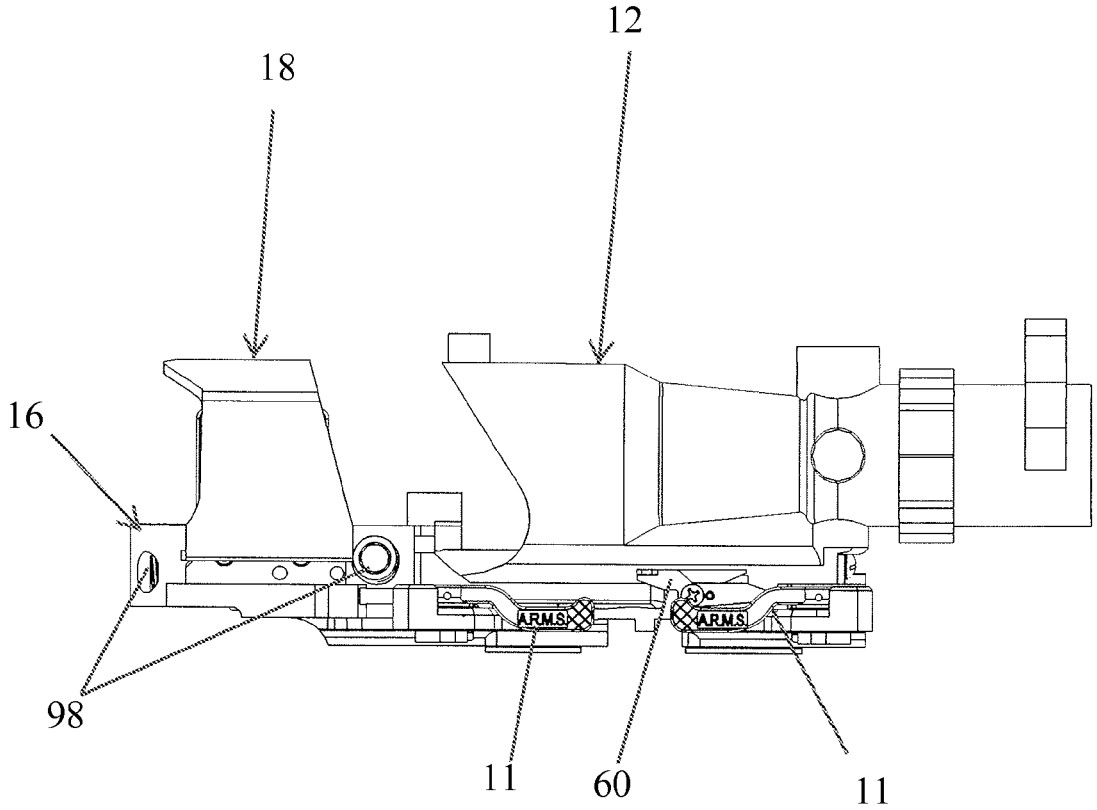
FIG. 7B is a right view of the first embodiment of the optic mount in a first configuration, with the locking switch in a locked position.
Figure 7C:
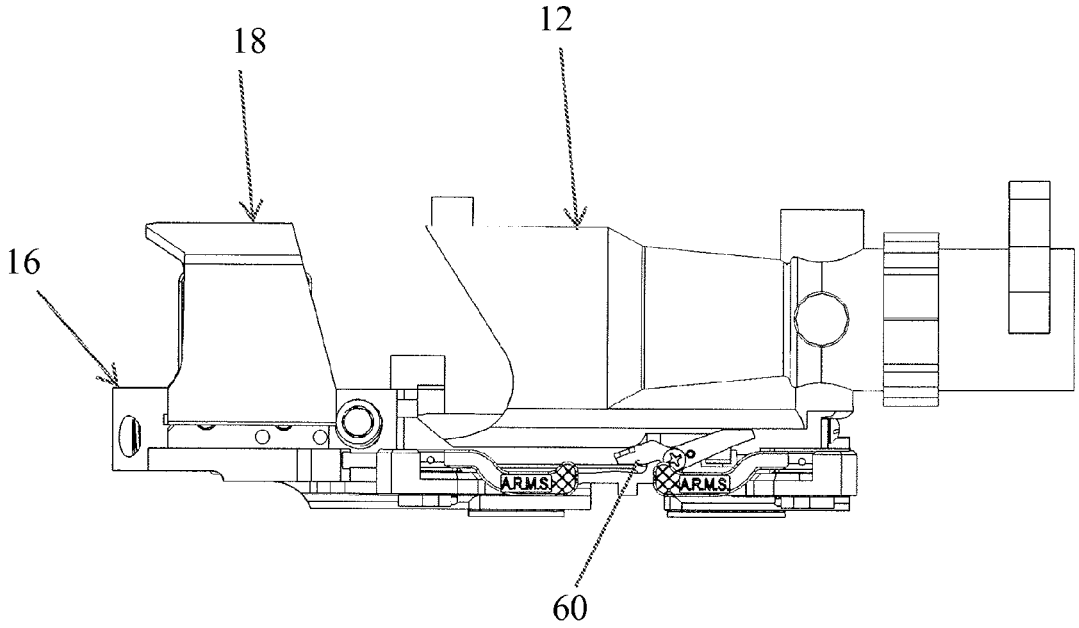
FIG. 7C is a view thereof with the locking switch in an unlocked position.

To allow a user to pivot the primary optic 12 between the first position and the second position, the primary optic is mounted on a swing arm assembly, which includes a swing arm 20 and a locking post (rod). The swing arm 20 is pivotably secured to the base 16 by a shaft 22 that extends through shaft receiving apertures 23A, 23B in the base 16 and the swing arm 20, respectively. FIG. 7A shows an exploded perspective view of the base 16, the swing arm 20, and the shaft 22. The swing arm 20 is spring-biased in a forward position. A coil spring 24 extends around at least a portion of the shaft 22, and the coil spring 24 is received within a spring receiver 25 on the base 16. The spring 24 has a first end that engages a surface on the swing arm 20, and a second end that engages a spring retainer 26 that is secured to the base 16. The shaft 22 allows the swing arm 20 to be translated linearly with respect to the base 16, and pivoted about the base 16. By translating and pivoting the swing arm 20, as discussed in more detail below, the primary optic 12 is movable from the first position to the second position and back.

Figure 8:
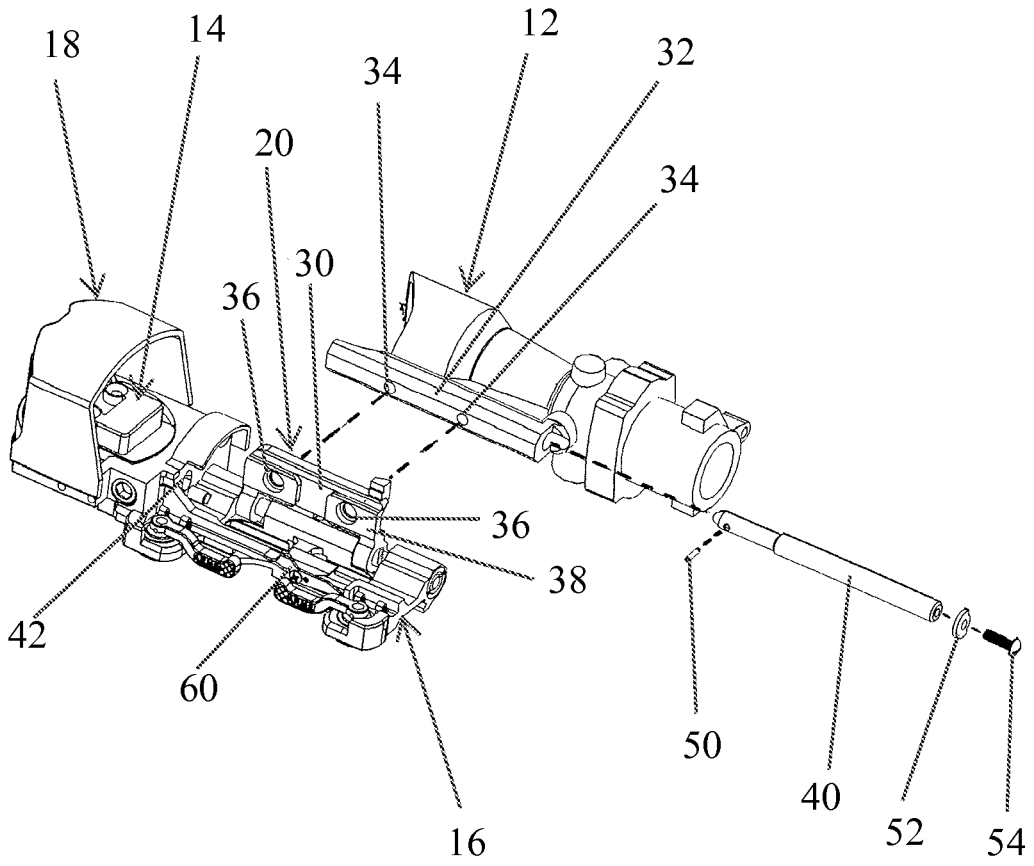
FIG. 8 is an exploded view of the primary optic and base.

The swing arm 20 has an upper surface 28 that is configured to receive the primary optic 12, and a lower surface 30 that is configured to engage the base 16 when the swing arm 20 and primary optic 12 are pivoted to the first position. FIG. 8 shows the optic mount before the primary optic 12 has been secured to the swing arm 20. The primary optic 12 in the exemplary embodiment has a foot 32 that is secured to the upper surface 28 of the swing arm 20. FIG. 8 shows fastener holes 34 on the foot 32 of the primary optic 12 and fastener holes 36 on the swing arm 20, allowing the primary optic 12 to be fastened to the swing arm 20. It should be noted here that the upper surface 28 of the swing arm 20 as illustrated is configurable to readily accept the lower housings of other types and brands of optics.

In the embodiment of FIG. 8, a rod, or locking post, 40 extends through the foot 32 of the primary optic 12. The locking post is secured to the primary optic so that it cannot translate with respect to the primary optic 12. For example, in FIG. 8, a pin, or roll pin, 50 is received in the locking post 40 towards the front end of the locking post 40 in front of the foot after the locking post has been extended through the foot 32. A washer 52 is seated on the rear end of the foot 32, and a fastener 54 extends through the washer 52 into the locking post 40. The pin and fastener thus constrain the translational motion of the locking post 40 with respect to the foot 32 of the primary optic 12. When the primary optic 12 is in the first position, the swing arm 20 is spring biased forward (toward the secondary optic in the embodiment of FIG. 8) so the locking post 40 is received in the first locking recess 42. The locking post 40 and first locking recess 42 prevent the swing arm 20 from being pivoted with respect to the base 16. A user disengages the locking post 40 from the first locking recess 42 by pulling the swing arm 20 rearward.

In some embodiments, not shown, to further prevent the swing arm 20 from pivoting about the base 16 when the primary optic 12 is in the first position, a tab on the swing arm engages a tab recess on the base. For example, the tab extends forward from a lower projection on the swing arm. The lower projection 38 is received within an opening 39 defined on the base. A tab recess is defined on the lower surface of the base adjacent to an opening in the base. The tab recess has a tab recess surface. The upper surface of the tab engages the tab recess surface. The swing arm is spring biased forward so the tab extends into the tab recess. A user disengages the tab from the tab recess by pulling the swing arm rearward.

To prevent the locking post from disengaging the first locking recess and (in some embodiments) to prevent the tab from disengaging the tab recess, the base includes a locking switch 60 for preventing rearward movement of the swing arm 20 when the swing arm 20 is in the first position. The locking switch 60 is secured to the base 16 by a fastener 62, and a user can pivot the locking switch 60 about the fastener 62 between an unlocked orientation, shown in FIG. 7B, and a locked orientation, shown in FIG. 7C. Once the locking switch 60 is pivoted to one of these orientations, a detent (not shown) corresponding to the respective orientations resists pivoting of the locking switch 60 from the respective orientation.

The locking switch 60 has a locking tab 64 that extends inwardly from the locking switch 60 to engage a corresponding locking arm 66 on the swing arm 20. In the embodiment shown, the locking arm has a rear face 68 for engaging the locking tab 64 of the locking switch 60. When the swing arm 20 is in the first position and the locking switch 60 is moved to the locking orientation, the locking tab 64 engages the rear surface 68 of the locking arm 66, preventing rearward movement of the swing arm 20 with respect to the base 16.

When the user wishes to move the swing arm 20 from the first position to the second position, the user pivots the locking switch 60 from the locked orientation to the unlocked orientation, causing the locking tab 64 to disengage the rear face 68 of the locking arm 66. The locking arm 66 has a recess 70 formed on its lower surface, so that the locking arm 66 of the swing arm 20 may slide over the locking tab 64 of the locking switch 60 when the locking switch is in this unlocked position. The user may move the swing arm rearwardly and then move it to the second position.

Figure 10:
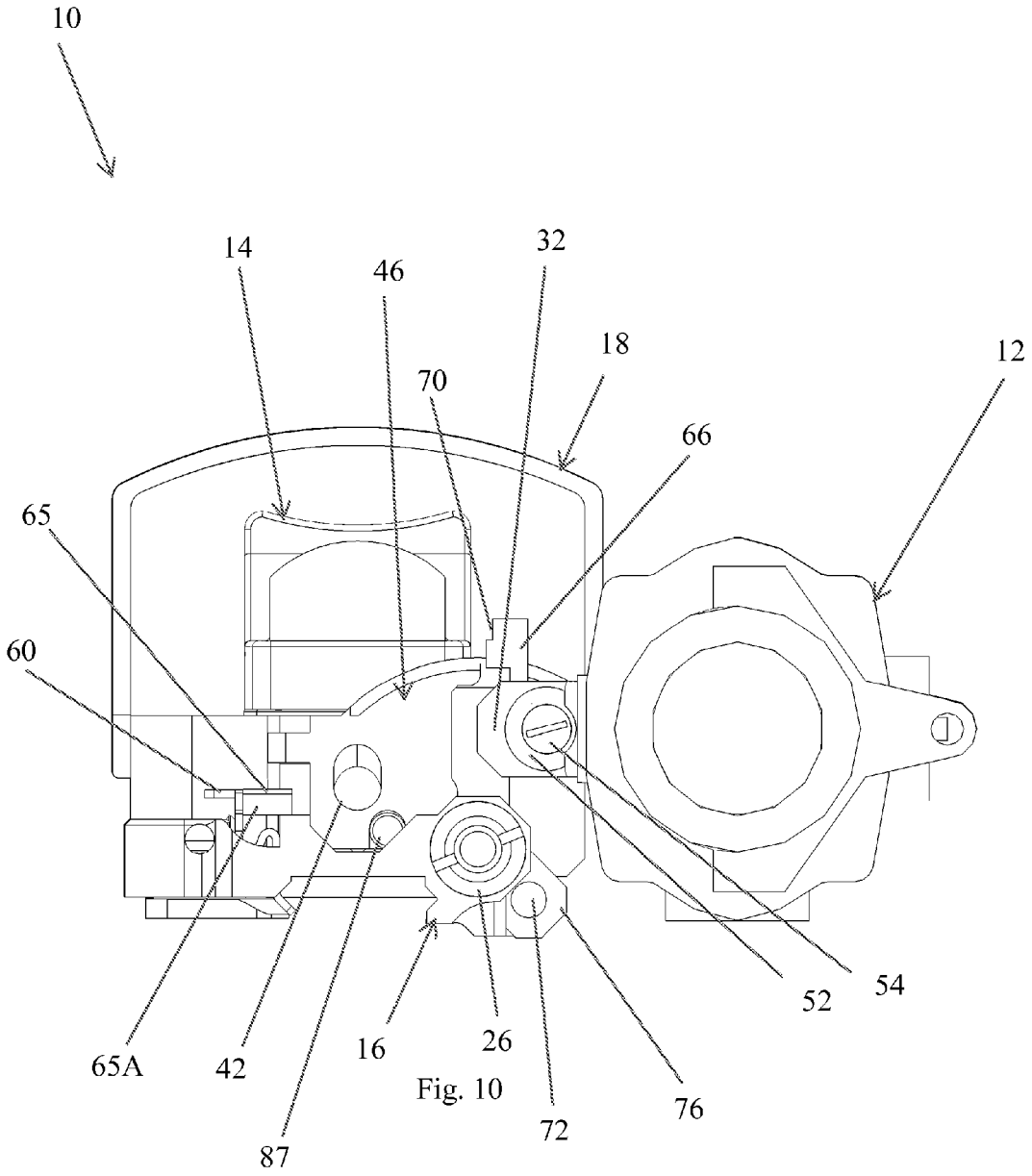
FIG. 10 is a rear view of the optic mount of the present invention in a second configuration.
Figure 13:
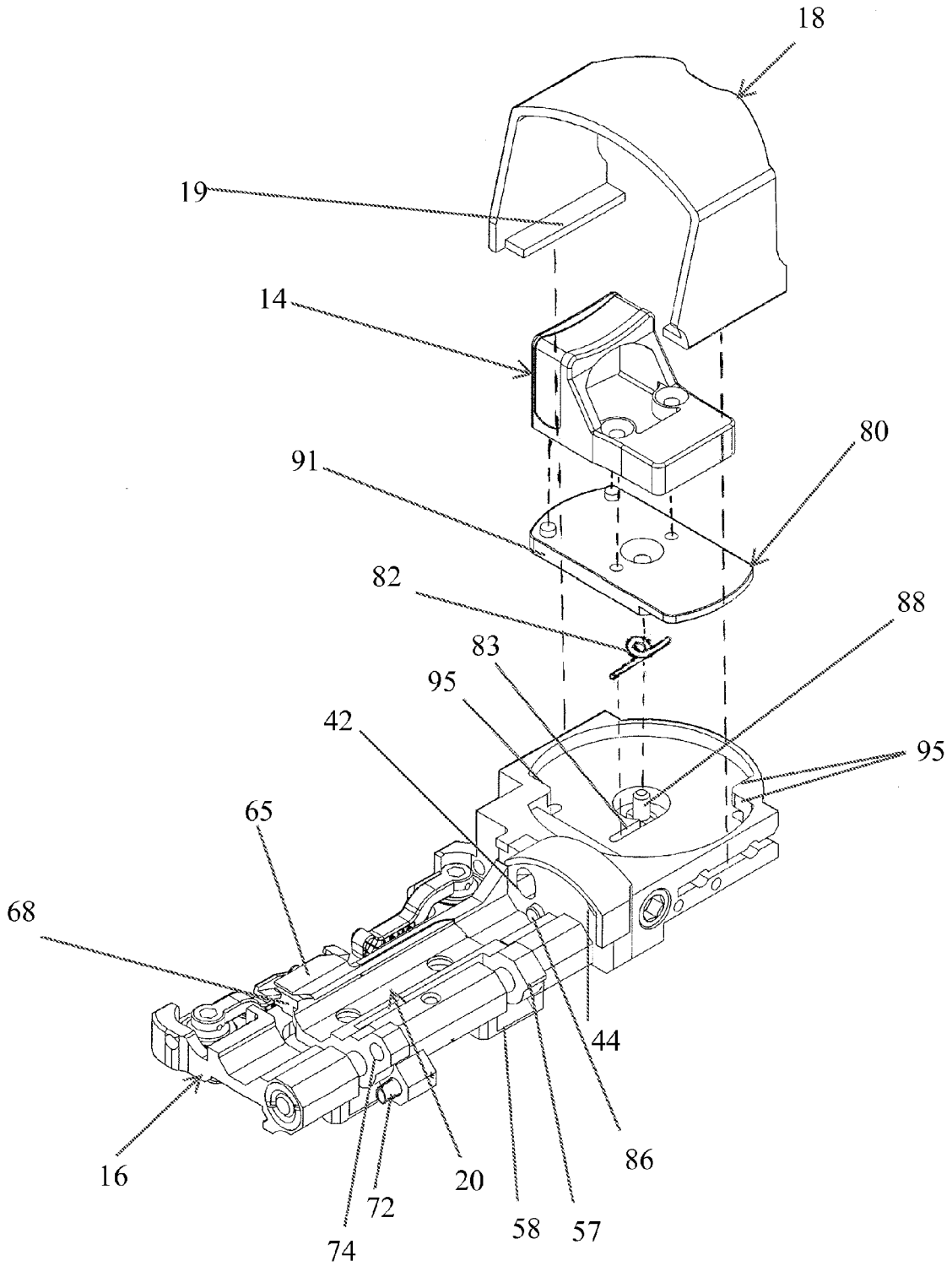
FIG. 13 is an exploded perspective view of the secondary optic, the secondary optic platform and the base.

Additionally, as seen in FIGS. 2, 10, and 13, the locking arm 66 on the swing arm is configured to engage the locking arm 65 on the base, each having a sloped surface so that the sloped surface 66A of the locking arm 66 on the swing arm 20 may slide under the sloped surface 65A of the locking arm 65 of the base when the swing arm is moved into the first position. When the swing arm is moved forward into the first position by the spring bias of the coil spring 24, the sloped surface 65A of the locking arm 65 of the base 16 prevents rotation of the swing arm with respect to the base.

Movement of the swing arm 20 completely from the first position to the second position is aided by a ledge 57 formed on the swing arm 20 that engages an outer edge 58 of the base 16 when the swing arm 20 has been completely moved to the second position.

Figure 11:
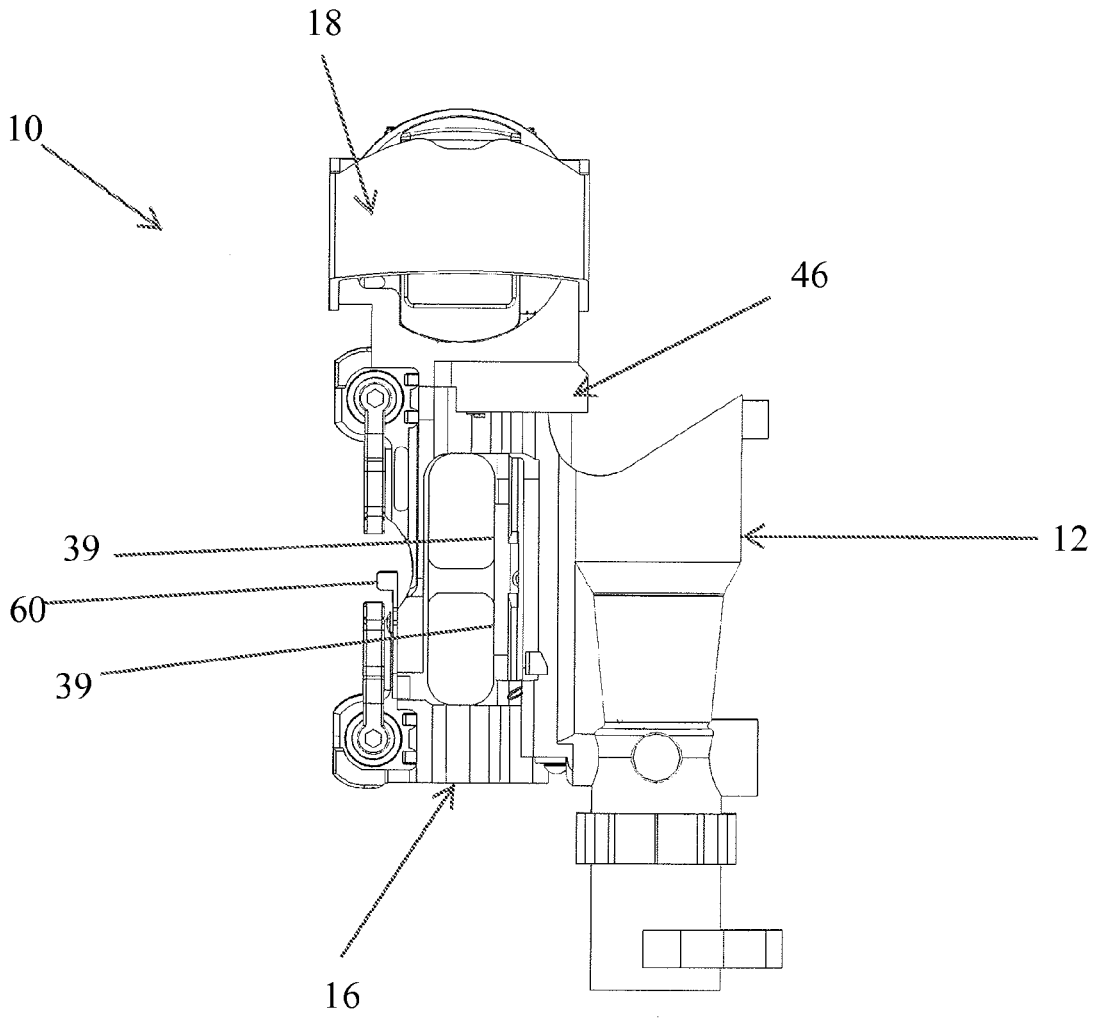
FIG. 11 is a top view thereof.
Figure 12:
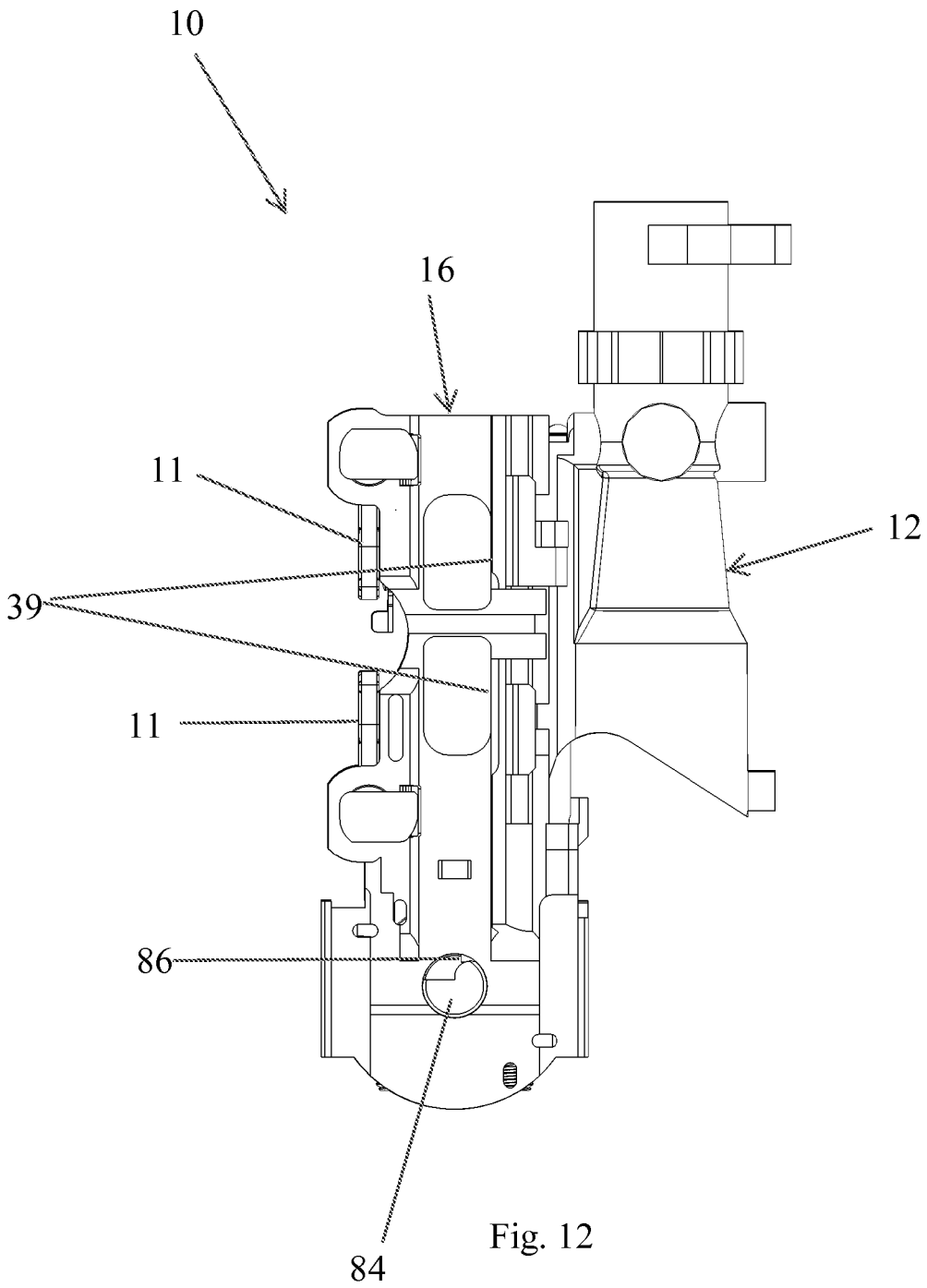
FIG. 12 is a bottom view thereof.

FIG. 10 shows a rear view of the optic mount when the user has moved the primary optic 12 to the second position. The secondary optic 14 is spring-biased to the first orientation in which the sight line of the secondary optic 14 is parallel with the barrel of the firearm (not shown). FIGS. 10-12 show that when the primary optic 12 is in the second position, it is offset from the base 16 and does not interfere with the sight line of the secondary optic 14.

To prevent the swing arm 20 from pivoting with respect to the base 16 when the swing arm 20 is in the second position, a dowel pin 72 on the base 16 is received in a locking aperture 74 on the swing arm 20. The dowel pin 72 extends outwardly from the base 16. The dowel pin 72 may be integrally formed in the base 16 or it may be received in a dowel pin aperture 73 shown in FIG. 7A before the dowel pin 72 has been inserted into the dowel pin aperture 73. The locking aperture 74 is defined on a locking structure 76 on the swing arm 20, and is configured to receive the dowel pin 72. FIG. 10 shows the dowel pin 72 received in the locking aperture 74 of the locking structure 76. A user disengages the locking aperture from the dowel pin by pulling the swing arm against the spring bias of the coil spring, which is rearward in the embodiment of FIG. 10.

To further prevent pivoting of the swing arm 20 with respect to the base 16 when the swing arm 20 is in the second position, the locking post 40 is received in a second locking recess 44 defined on the base 16. A user disengages the locking post from the second locking recess by pulling the swing arm against the spring bias of the coil spring, which is in this case rearward.

The secondary optic 14 is mounted on a structure that adjusts the orientation of the secondary optic 14 in response to the position of the primary optic. As shown in FIGS. 13-16, the secondary optic 14 is mounted on a swivel platform 80 towards the front of the optic mount 10. The swivel platform is positioned over the base, and has an upper surface to which the secondary optic 14 can be secured. It should again be noted here that the upper surface of the swivel platform 80 as illustrated is designed to accept the miniature reflex sight as illustrated, however the upper surface can be configured to readily accept the lower housings of other types of non-magnifying or magnifying optics.

The swivel platform 80 can be rotated from a first orientation to a second orientation. FIG. 13 shows the swivel platform rotated to the second orientation. The sight line of the secondary optic 14 is substantially parallel to the barrel of the firearm when the secondary optic is in the first orientation, and the sight line is substantially perpendicular to the barrel of the firearm when the secondary optic is in the second orientation.

A torsional spring 82 causes the swivel platform to be spring-biased to the first orientation. The torsional spring 82 has a first end that is secured to the swivel platform 80 and a second end that is secured to the base 16 in a spring receiving slot 83.

The swivel platform 80 can be rotated in the opposite direction of the spring bias of the torsional spring 82, and then released to return to its original position. The swivel platform 80 is driven by a cam 84 and push rod 86 that are actuated by movement of the swing arm assembly. The swivel platform 80 engages a swivel shaft 88 that is rotatably supported within the base 16. The swivel shaft 88 has a cam surface that engages the first end of a push rod that extends within the base. Translation of the push rod towards the cam causes the swivel shaft and the connected swivel platform to rotate. The second end of the push rod engages an actuator portion of the swing arm assembly. The actuator portion of the swing arm assembly may be a front surface of the swing arm itself, or a front surface of the primary optic, or another structure attached to the swing arm 20. When the swing arm 20 is in the first position, the actuator portion of the swing arm assembly is spring biased forward and drives the push rod 86 forward. The push rod 86 engages the cam 84 and rotates the swivel platform 80 and secondary optic 14 to the second orientation.

Figure 14:
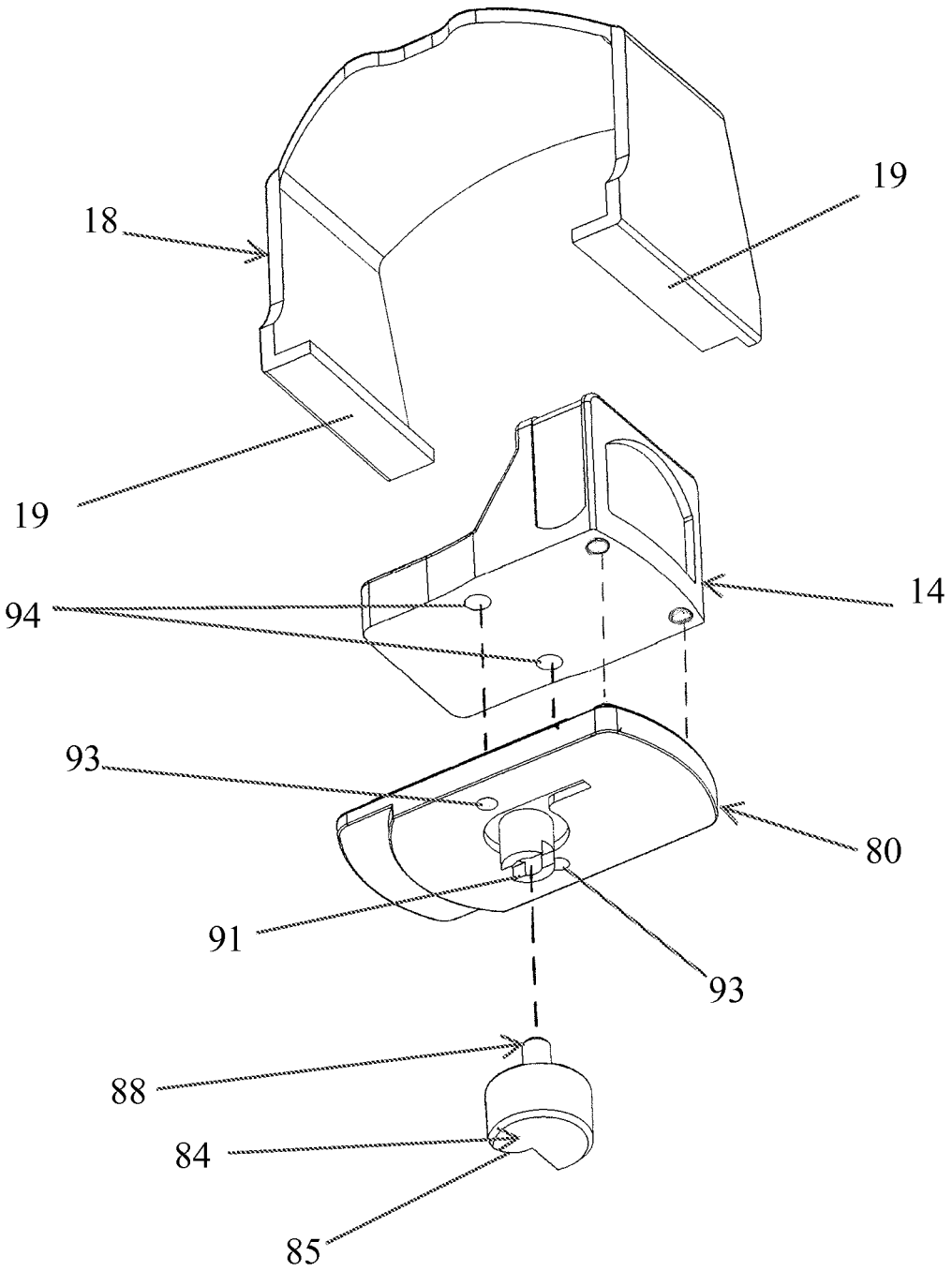
FIG. 14 is a lower perspective view thereof, without the base.
Figure 15:
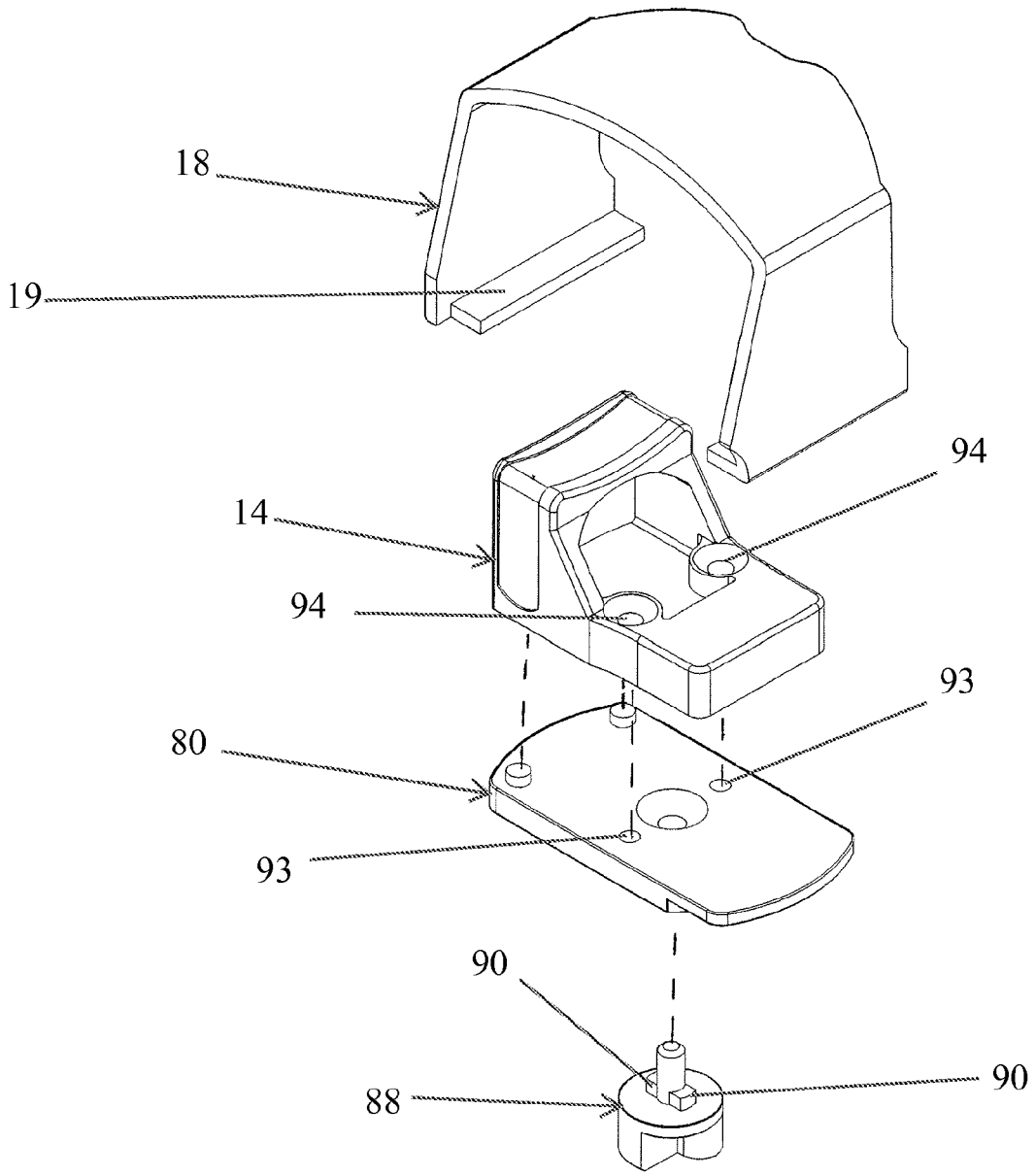
FIG. 15 is an upper perspective view thereof.
Figure 16:
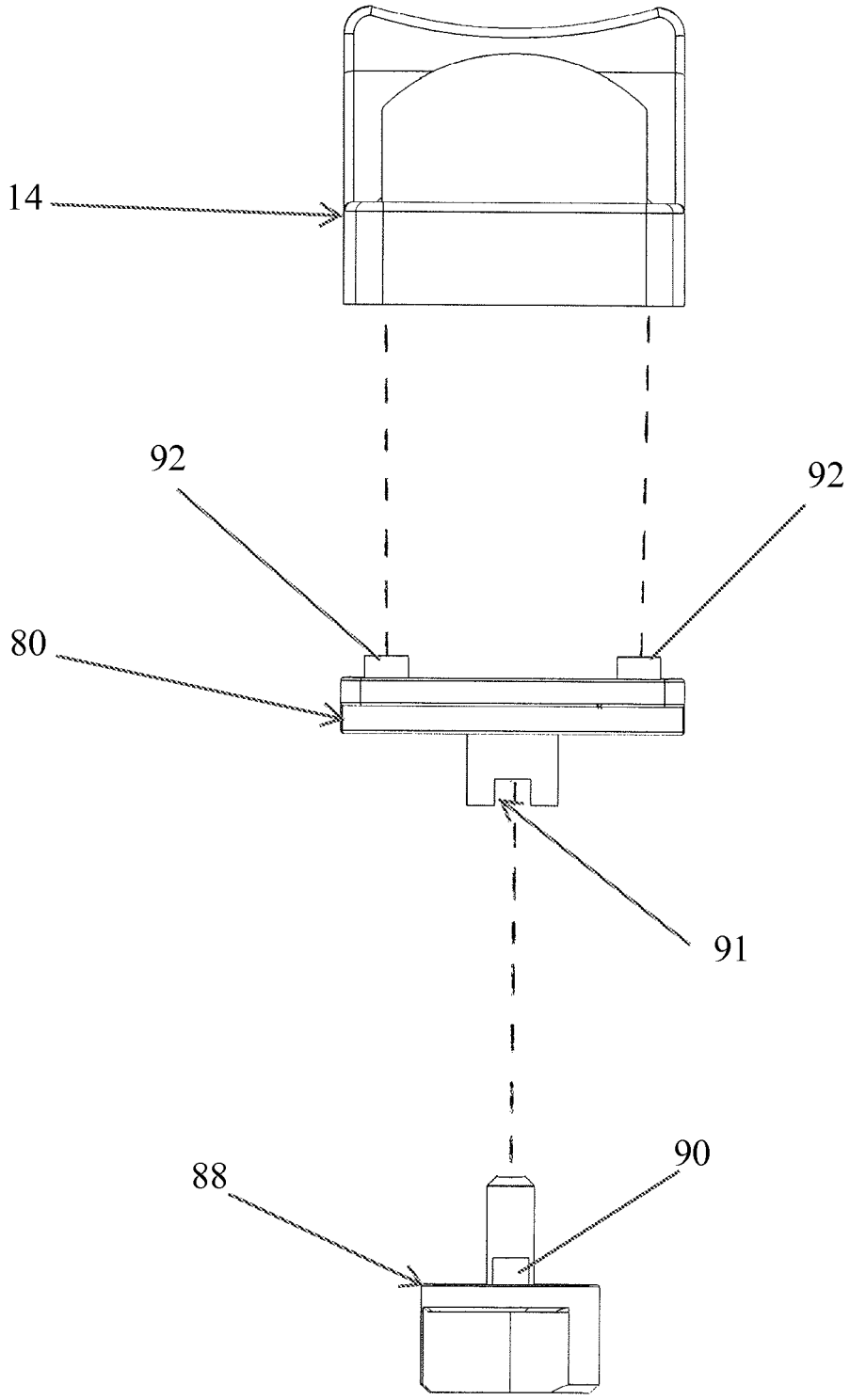
FIG. 16 is an exploded view of the secondary optic, swivel platform and swivel shaft.
Figure 17A:
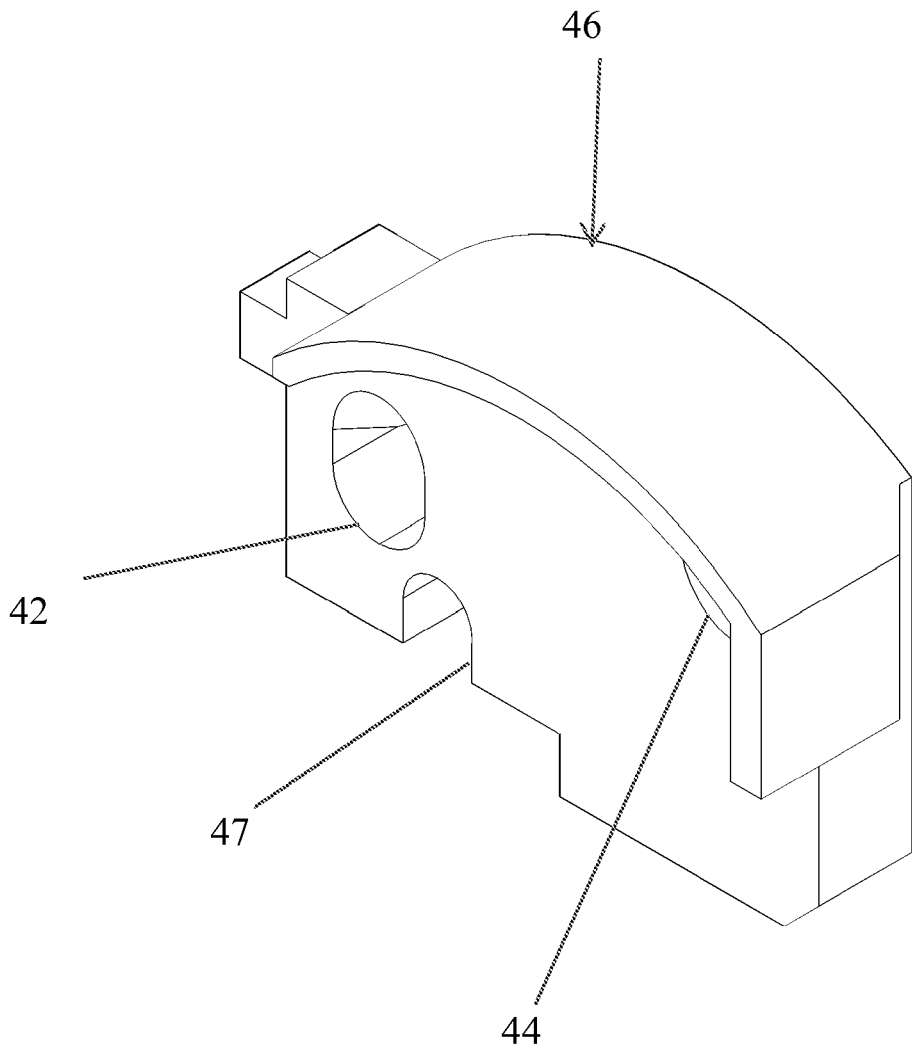
FIGS. 17A-E are views of an arched cover plate that can be secured to the base for engaging the locking post.
Figure 17B:
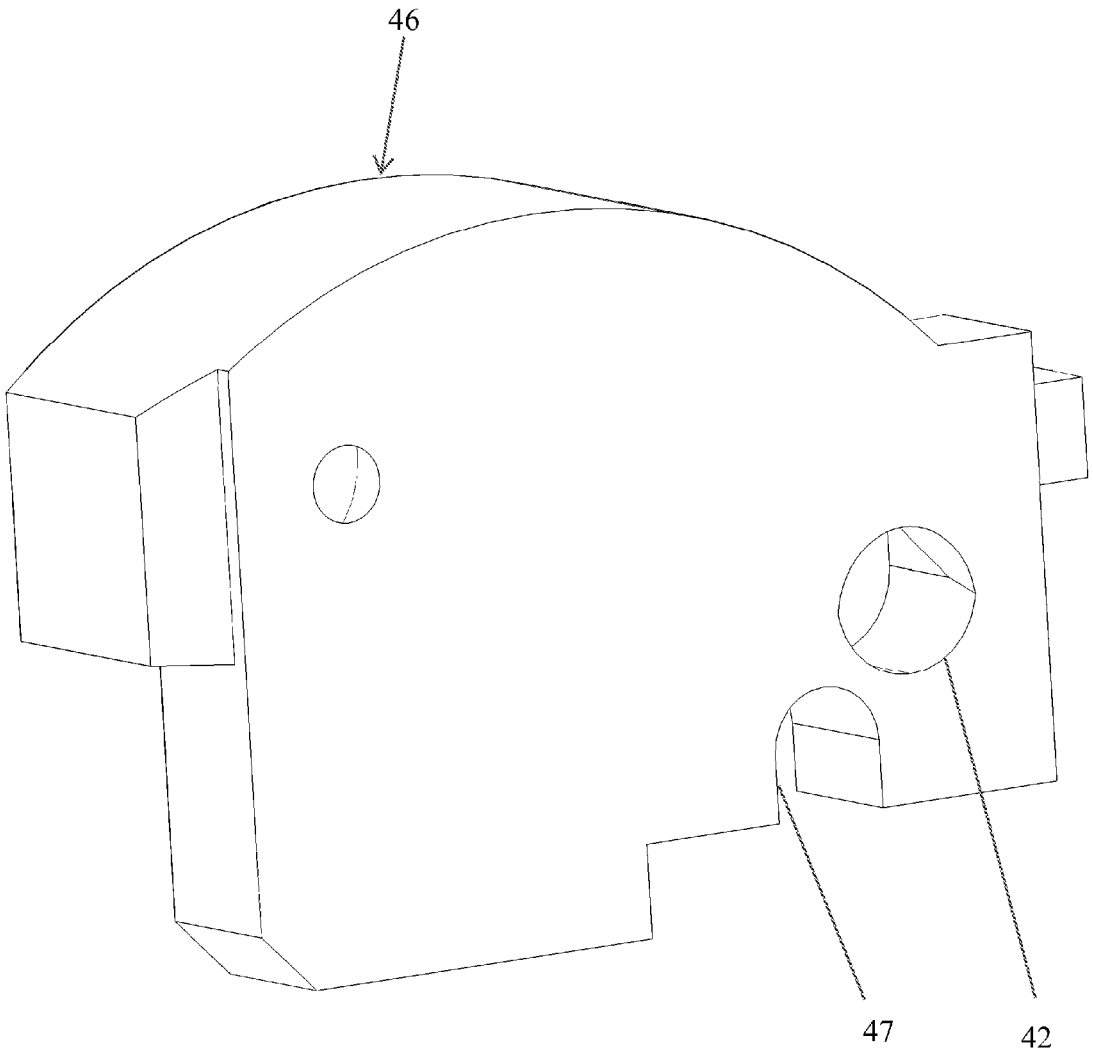
Figure 17C:
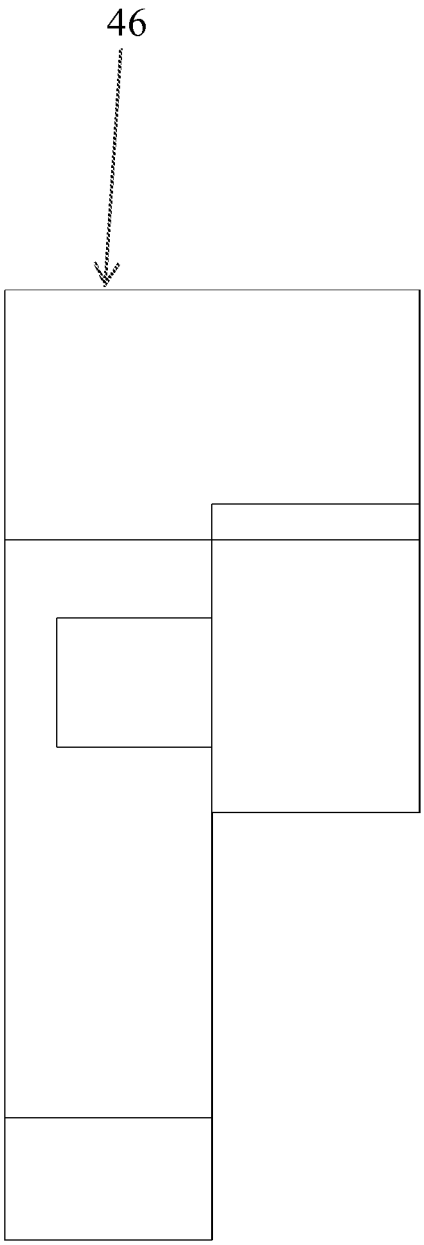
Figure 17D:
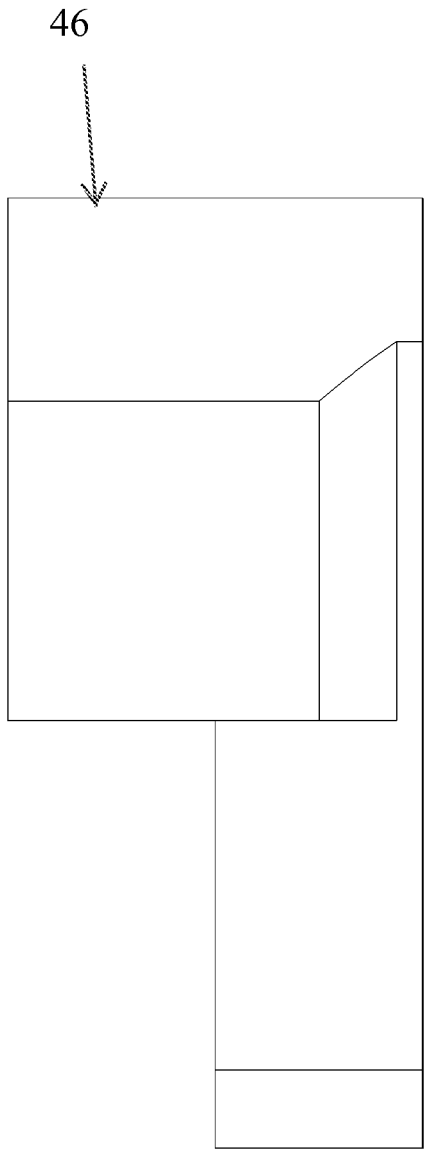
Figure 17E:
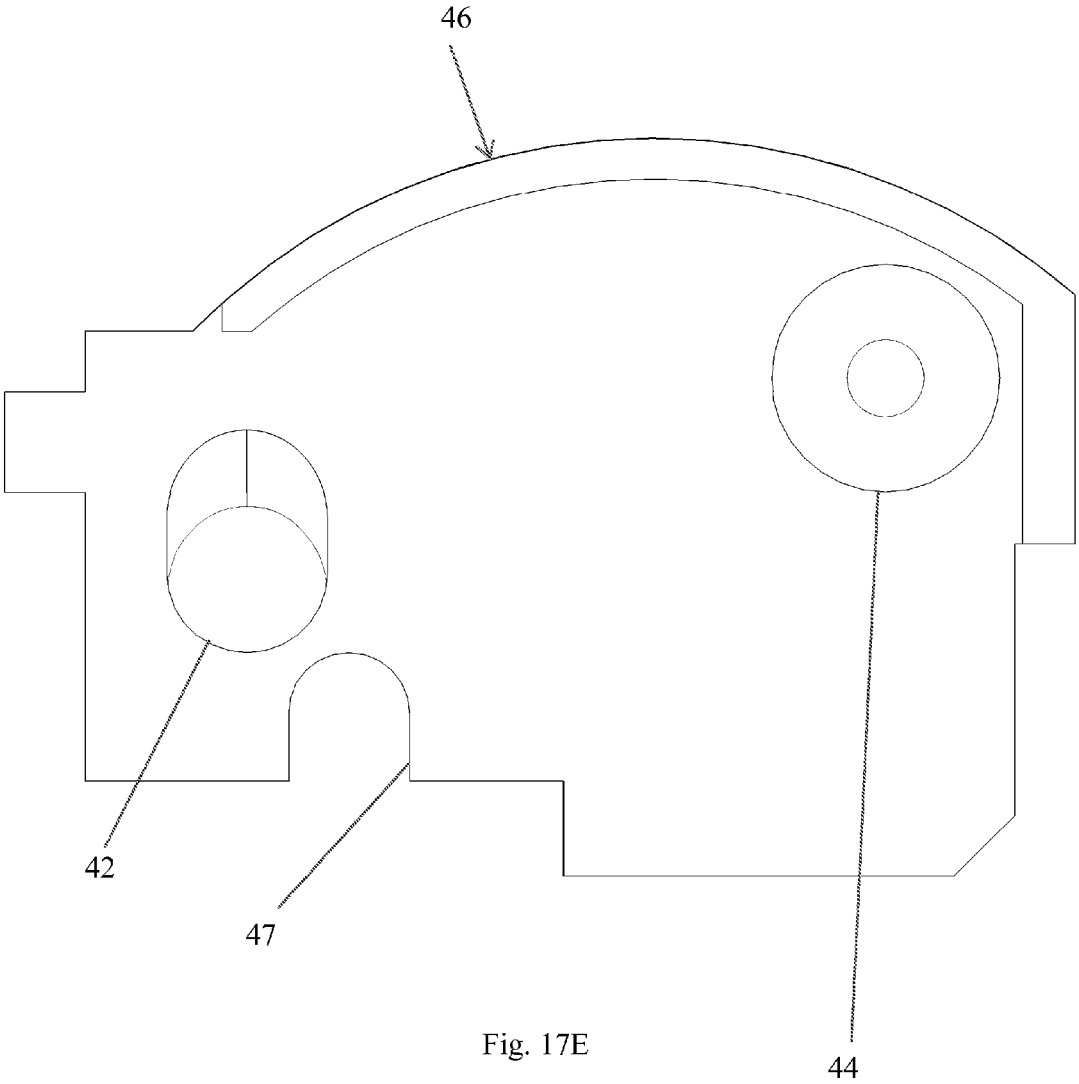

The cam surface 85 of the cam 84 at the lower end of the swivel shaft 88 is generally depicted in FIGS. 14-16. The interaction of the cam surface of the swivel shaft and the push rod 86 is depicted in FIGS. 9 and 12. FIG. 9 shows the bottom view when the primary optic 12 is in the first position and the second optic 14 is in the second orientation, while FIG. 12 shows the bottom view when the primary optic 12 is in the second position and the secondary optic 14 is in the first orientation. When the actuator portion of the swing arm assembly engages the push rod face 87, the push rod 86 and cam 84 are moved from the configuration shown in FIG. 12 to the configuration shown in FIG. 9.

As shown in FIG. 16, the upper end of the swivel shaft 88 has a narrow portion that is received within the swivel platform 80. Shaft projections 90 on the upper end of the swivel shaft are received in notches 91 formed on the lower end of the swivel platform 80 to rotatably link the swivel shaft 88 with the swivel platform 80. Posts 92 extend upwardly from the swivel platform for supporting the secondary optic 14. These posts 92 are received within the secondary optic 14. Fastener holes 93 in the swivel platform and fastener holes 94 in the secondary optic allow the secondary optic 14 to be secured to the swivel platform 80 by threaded fasteners (not shown).

Rotation of the swivel platform 80 and secondary optic 14 are limited by at least one stop wall 95 formed on the base, shown in FIG. 13. Each stop wall 95 engages a respective portion of the side surface 81 on the swivel platform 80, or the secondary optic 14 itself, to limit rotation of the swivel platform 80 and secondary optic 14 with respect to the base 16 beyond the first orientation. At least one stop wall 95 opposes the spring bias of the torsional spring 82 when disengagement of the push rod 86 results in the swivel platform and secondary optic 14 returning from the second orientation to the first orientation, which is aligned with the barrel and useful for precise target acquisition. A stop wall 95 may also be provided to prevent the secondary optic and swivel platform from being rotated beyond the second orientation by the push rod and cam.

A shield 18 is secured to the base 16 so that the shield 18 extends over the secondary optic 14. The shield has tabs 19 that extend inwardly. Fastener holes may be formed on the tabs on the shield and on the lower surface of the base for receiving threaded fasteners. The shield can be removed to allow the user to affix or replace the secondary optic on the swivel platform. Threaded fasteners are not required to secure the shield to the base. The shield 18 may be frictionally secured to the base, for example, by tabs at opposing lower ends of the shield. These tabs are slid into place in slots formed on the base.

Because the primary and secondary optics are independently functional for acquiring a target, failure of one of the optics does not affect the operation of the other.

The size of the base 16 of the optic mount 10 can be dimensioned to allow other accessories to be mounted on the same dovetail rail. For example, a typical iron sight (not shown) can be mounted on the rail behind the optic mount, providing a backup sight if the primary and secondary optics are damaged during use.

With the present invention, when a user wants to acquire a target by viewing the target through the primary optic 12, the user arranges the optic mount 10 in a first configuration in which: the primary optic is in the first position, with the swing arm spring-biased forward; the actuator portion of the swing arm assembly engages the push rod face so the cam surface is rotated and the secondary optic is in the second orientation; the locking rod engages the first locking recess to prevent rotation of the primary optic about the shaft; a locking arm on the swing arm engages a locking arm on the base; and (optionally) a tab on the swing arm engages the tab recess surface to further prevent rotation of the primary optic about the shaft.

Alternatively, when the user wants to acquire a target by viewing the target through the secondary optic, the user arranges the optic mount in a second configuration in which: a ledge on the swing arm engages an outer edge of the base; the primary optic is in the second position, with the swing arm spring-biased forward; the locking aperture engages the dowel pin to prevent rotation of the primary optic about the shaft; the locking rod engages the second locking recess to further prevent rotation of the primary optic about the shaft; and the torsional spring bias causes the secondary optic to be rotated to the first orientation.

Movement between the two configurations is achieved by first moving the primary optic rearward, then pivoting it towards the desired position, and finally releasing the primary optic so it moves to a spring biased forward position. This is because when the primary optic is moved sufficiently rearward, the locking aperture 74 on the locking structure 76 of the swing arm does not engage the dowel pin 72, the locking post 40 does not engage either the first locking recess 42 or the second locking recess 44, and the locking arm 66 of the swing arm does not engage the locking arm 65 of the base 16.

This embodiment of the optic mount 10 has a removable latch cover 46 that is mounted on the base for receiving the locking post. FIGS. 17A-17E show a latch cover 46 that may be secured to the base 16. The latch cover has the first locking recess 42 and second locking recess 44 formed thereon. Additionally, the latch cover has a channel 47 through which the push rod extends when the plate is secured to the base. It has a fastener hole so it can be secured to the base, for example by a threaded fastener. The locking post of the swing arm assembly is received within the first locking post receiver when the swing arm is in the first position. The locking post of the swing arm assembly is received within the second locking post receiver when the swing arm is in the second position.

There may be more than one dowel pin and associated locking aperture and locking structure.

The optic mount 10 may include sockets 98 for electrical components such as lights (not shown) or lasers (not shown).

Figure 18:
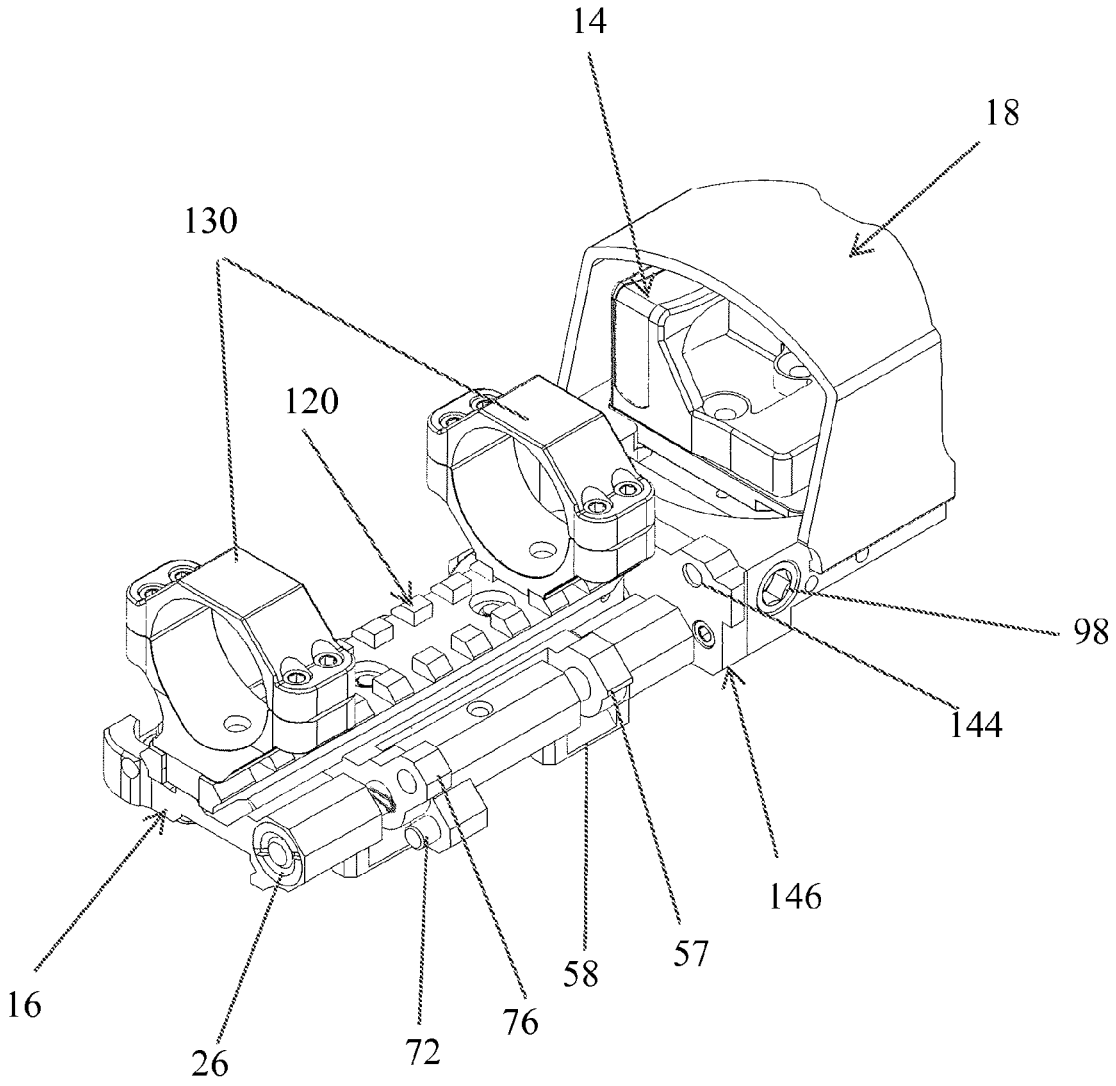
FIG. 18 is a perspective view of a second embodiment of the optic mount in a first configuration.
Figure 19:
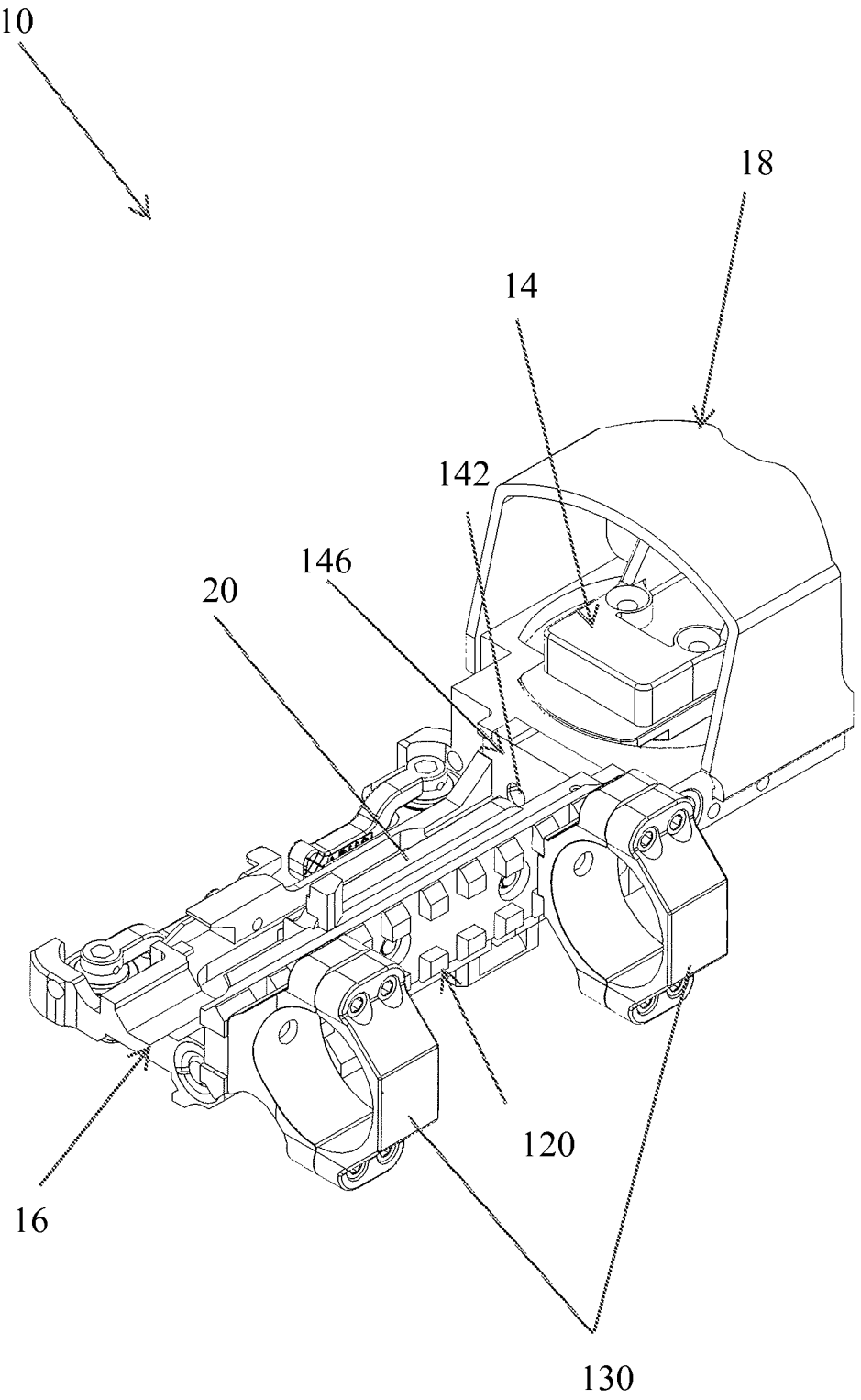
FIG. 19 is a perspective view thereof in a second configuration.

FIGS. 18 and 19 show a second embodiment of the optic mount of the present invention. In this embodiment, a universal mounting rail 120 is secured to the upper surface of the swing arm 20 so sighting devices that require dovetail interfaces or scope rings may be mounted thereon. The universal mounting rail 120 is similar in design to a typical dovetail rail formed on the upper surface of a firearm (not shown). The figures show the rail 120 supporting rings 130 for securing a sighting device to the optic mount 10. The forward surface of the primary optic, the forward surface of the swing arm, or the forward surface of the mounting rail secured to the swing arm engages the push rod to drive the cam when the swing arm is in the first position.

Figure 20:
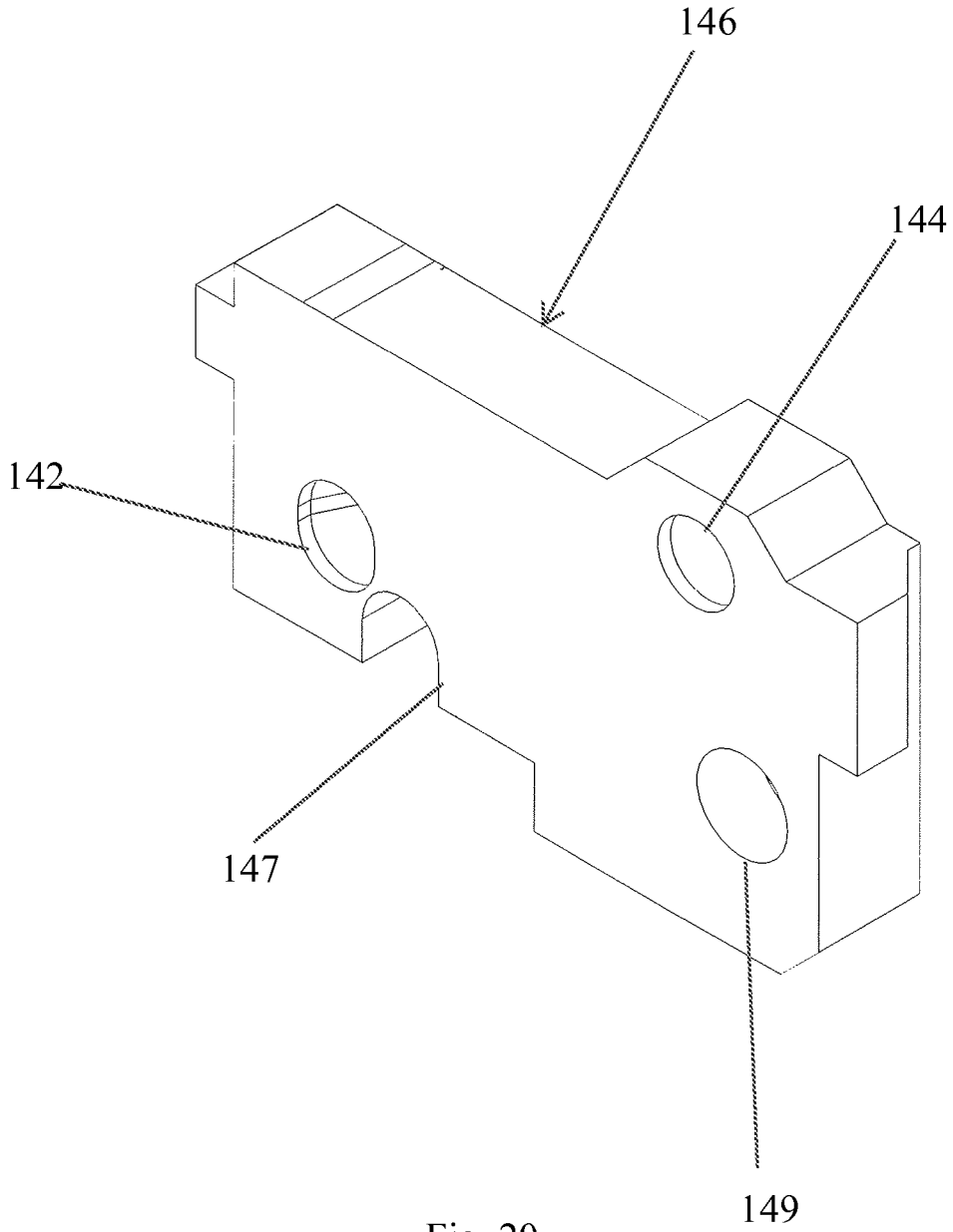
FIG. 20 is a perspective view of a cover plate that can be secured to the base of the second embodiment of the optic mount for engaging the locking post.

FIG. 20 shows an alternate plate 146 that is be secured to the base 116 in the second embodiment. The plate has the first locking recess 142 and second locking recess 144 formed thereon. Additionally, the plate has an arched passage 147 through which the push rod extends when the plate is secured to the base. The plate 146 is secured to the base 116 by a fastener extending through a fastener hole 149.

For the purpose of illustration, the optic mount of the present invention is described in conjunction with a firearm having a dovetail rail. However, it is possible to configure the base of the optic mount to engage other firearms having other attachment structures.

It can therefore be seen that the present invention provides an optic mount for a firearm that allows a user to easily and rapidly switch back and forth between a primary optic and a secondary optic. The optic mount provides a primary optic and a secondary optic that operate independently of one another. For these reasons, the instant invention is believed to represent a significant advancement in the art which has substantial commercial merit.

While there is shown and described herein certain specific structure embodying the invention, it will be manifest to those skilled in the art that various modifications and rearrangements of the parts may be made without departing from the spirit and scope of the underlying inventive concept and that the same is not limited to the particular forms herein shown and described except insofar as indicated by the scope of the appended claims.

What is claimed is:

1. An optic mount for supporting a primary optic and a secondary optic on a firearm for use in both close quarter engagement and long range engagement, the optic mount comprising:

a base capable of being secured to a firearm;

a primary optic platform pivotably secured to the base and linearly translatable with respect to the base;

the primary optic platform being spring biased forward with respect to the base;

a secondary optic platform rotatably secured to the base, the secondary optic platform being rotatable from a first orientation to a second orientation;

the secondary optic platform being spring biased to the first orientation;

an actuator mechanism linked to the secondary optic platform;

wherein the primary optic platform engages the actuator mechanism when the primary optic platform is in a first position, thereby causing the secondary optic platform to be rotated to the second orientation;

wherein the primary optic platform does not engage the actuator mechanism when the primary optic platform is in a second position, thereby allowing the secondary optic platform to rotate to the first orientation; and wherein the secondary optic platform is a swivel platform, the swivel platform being rotatably positioned over the base and secured to a swivel shaft that is rotatably secured within the base, the swivel platform having an upper surface configured to receive a secondary optic, the swivel platform being rotatable from a first orientation in which the sight line of the secondary optic is substantially parallel to the barrel of the firearm to a second orientation in which the sight line of the secondary optic is substantially perpendicular to the barrel of the firearm.

2. The optic mount of claim 1, further comprising:

a first locking recess defined on a surface on the base;

a second locking recess defined on a surface on the base;

wherein the primary optic platform is a swing arm assembly;

wherein the swing arm assembly includes a swing arm and a locking post, the swing arm being rotatably secured to the base by a shaft extending through the base and the swing arm, the swing arm having an upper surface configured to receive a primary optic, the primary optic having a foot that is secured to the swing arm, the swing arm capable of being translated linearly with respect to the base and capable of being pivoted about the base, the swing arm thereby being movable from a first position in which the primary optic is secured directly over a barrel of the firearm to a second position in which it is offset from the barrel; and further wherein the first locking recess is configured to receive the locking post and the second locking recess is configured to receive the locking post.

3. The optic mount of claim 2, further comprising:

a spring extending around at least a portion of the shaft and, the spring being received within a spring receiver on the base, the spring having a first end that engages a surface on the swing arm, the spring having a second end that engages a spring retainer that is secured to the base, whereby the swing arm is spring-biased forward.

4. The optic mount of claim 2, further comprising:

a dowel pin extending outwardly from the base; and a locking aperture defined on a locking structure on the swing arm, the locking aperture configured to engage the dowel pin.

5. The optic mount of claim 1, wherein the base is configured to engage a dovetail rail on a firearm; and further wherein a locking assembly is on the base for securing the base to a firearm.

6. The optic mount of claim 1, further comprising:

a torsional spring having a first end secured to the swivel platform and a second end secured to the base so the swivel platform is spring-biased to the first orientation.

7. The optic mount of claim 6, further comprising:

at least one stop wall on the base capable of engaging at least one side surface of the swivel platform to limit rotation of the swivel platform with respect to the base beyond the first orientation.

8. The optic mount of claim 1, wherein the actuator mechanism further comprises:

a cam surface formed on the swivel shaft; and a push rod having a first end for engaging the cam surface to rotate the swivel shaft and a second end having a push rod face for engaging an actuator portion of the primary optic platform.

9. The optic mount of claim 1, further comprising:

a shield secured to the base and capable of extending over a secondary optic secured to the secondary optic platform.

10. An optic mount for supporting a primary optic and a secondary optic on a firearm for use in both close quarter engagement and long range engagement, the optic mount comprising:

a base;

a lower surface on the base that is configured to engage a dovetail rail on a firearm;

a locking assembly on the base for securing the base to a firearm;

an opening defined in the base;

a dowel pin extending outwardly from the base;

a swing arm assembly including a swing arm and a locking post, the swing arm rotatably secured to the base by a shaft extending through the base and the swing arm, the swing arm having an upper surface configured to receive a primary optic, the primary optic having a foot that is secured to the swing arm, the swing arm capable of being translated linearly with respect to the base and capable of being pivoted about the base, the swing arm thereby being movable from a first position in which the primary optic is secured directly over a barrel of the firearm to a second position in which it is offset from the barrel;

a locking aperture defined on a locking structure on the swing arm, the locking aperture configured to engage the dowel pin;

a spring extending around at least a portion of the shaft and, the spring being received within a spring receiver on the base, the spring having a first end that engages a surface on the swing arm, the spring having a second end that engages a spring retainer that is secured to the base, whereby the swing arm is spring-biased forward;

a first locking recess defined on a surface on the base, the first locking recess configured to receive the locking post;

a second locking recess defined on the surface of the base, the second locking recess configured to receive the locking post;

a swivel platform rotatably positioned over the base and secured to a swivel shaft that is rotatably secured within the base, the swivel platform having an upper surface configured to receive a secondary optic, the swivel platform being rotatable from a first orientation in which the sight line of the secondary optic is substantially parallel to the barrel of the firearm to a second orientation in which the sight line of the secondary optic is substantially perpendicular to the barrel of the firearm;

a torsional spring having a first end secured to the swivel platform and a second end secured to the base so the swivel platform is spring-biased to the first orientation;

a cam surface formed on the swivel shaft;

a push rod having a first end for engaging the cam surface to rotate the swivel shaft and a second end having a push rod face for engaging an actuator portion of the swing arm assembly;

at least one stop wall on the base capable of engaging at least one side surface of the swivel platform to limit rotation of the swivel platform with respect to the base beyond the first orientation;

a shield secured to the base and capable of extending over the secondary optic;

the optic mount being capable of being arranged in a first configuration in which:

the primary optic is in the first position, with the spring biasing the spring arm forward;

the actuator portion of the swing arm assembly in engagement with the push rod face so the cam surface is rotated and the secondary optic is in the second orientation, the locking rod engaging the first locking recess to prevent rotation of the primary optic about the shaft, whereby a user may acquire a target by viewing the target through the primary optic; and the optic mount being capable of being arranged in a second configuration in which:

the primary optic is in the second position with the spring biasing the swing arm forward;

the locking aperture engaging the dowel pin, to prevent rotation of the primary optic about the shaft;

the locking rod engaging the second locking recess to further prevent rotation of the primary optic about the shaft; and the torsional spring biasing the secondary optic to the first orientation;

whereby a user may acquire a target by viewing the target through the secondary optic.

* * * * *